US008718524B2

(12) United States Patent
Kimura

(10) Patent No.: US 8,718,524 B2
(45) Date of Patent: May 6, 2014

(54) FIXATION DEVICE AND IMAGE FORMATION APPARATUS

(75) Inventor: Taku Kimura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 208 days.

(21) Appl. No.: 13/090,679

(22) Filed: Apr. 20, 2011

(65) Prior Publication Data

US 2011/0262193 A1 Oct. 27, 2011

(30) Foreign Application Priority Data

Apr. 22, 2010 (JP) ..... 2010-098800

(51) Int. Cl.
*G03G 15/20* (2006.01)

(52) U.S. Cl.
USPC ..... 399/329

(58) Field of Classification Search
USPC ..... 399/320, 328, 329
See application file for complete search history.

(56) References Cited

U.S. PATENT DOCUMENTS 5,999,788 A * 12/1999 Kanesawa et al. ..... 399/329
7,664,449 B2 2/2010 Kimura
2003/0103788 A1* 6/2003 Yura et al. ..... 399/329
2005/0025537 A1* 2/2005 Echigo et al. ..... 399/329
2005/0191097 A1* 9/2005 Yoshida et al. ..... 399/329
2006/0147221 A1* 7/2006 Asakura et al. ..... 399/69
2009/0263169 A1* 10/2009 Kimura ..... 399/329

FOREIGN PATENT DOCUMENTS

JP 2002-311735 A 10/2002
JP 2003-228253 A 8/2003
JP 2005-031660 A 2/2005
JP 2006-259042 A 9/2006
JP 2007-322888 A 12/2007
JP 2009-69603 A 4/2009

* cited by examiner

*Primary Examiner* — David Gray
*Assistant Examiner* — Thomas Giampaolo, II
(74) *Attorney, Agent, or Firm* — Marvin A. Motsenbocker; Mots Law, PLLC

(57) ABSTRACT

A fixation device including: a conveyance member configured to convey media; a heater configured to heat the conveyance member; a pressure member being in contact with the conveyance member; a first sandwiching member disposed facing the pressure member with the conveyance member between the first sandwiching member and the pressure member and being in contact with the conveyance member; and a second sandwiching member disposed facing the pressure member with the conveyance member between the second sandwiching member and the pressure member and being in contact with the conveyance member.

22 Claims, 25 Drawing Sheets

Pressure distribution in nip in fixation device shown in Fig. 1

Pressure distribution in nip in comparison example

Pressure distribution in nip in comparison example

Pressure distribution in nip in fixation device shown in Fig. 1

FIXATION DEVICE AND IMAGE FORMATION APPARATUS

CROSS REFERENCE TO RELATED APPLICATIONS

This application claims priority based on 35 USC 119 from prior Japanese Patent Application No. 2010-098800 filed on Apr. 22, 2010, entitled "Fixation Device and Image Formation Apparatus", the entire contents of which are incorporated herein by reference.

BACKGROUND OF THE INVENTION

1. Field of the Invention

The invention relates to a fixation device for an image formation apparatus such as an electrophotographic printer, copy machine, facsimile, or the like and an image formation apparatus having the fixation device.

2. Description of Related Art

Conventionally, there is a fixation device configured to fix a developer image that is attached on a medium to the medium (see, for example, Japanese Patent Application Laid-Open No. 2007-322888).

SUMMARY OF THE INVENTION

However, in the conventional fixation device, a fixation may not be performed preferably.

A first aspect of the invention is a fixation device including: a conveyance member configured to convey a medium; a heater configured to heat the conveyance member; a pressure member being in contact with the conveyance member; a first sandwiching member disposed facing the pressure member with the conveyance member between the first sandwiching member and the pressure member and being in contact with the conveyance member; and a second sandwiching member disposed facing the pressure member with the conveyance member between the second sandwiching member and the pressure member and being in contact with the conveyance member.

DETAILED DESCRIPTION OF EMBODIMENTS

Figure 1:
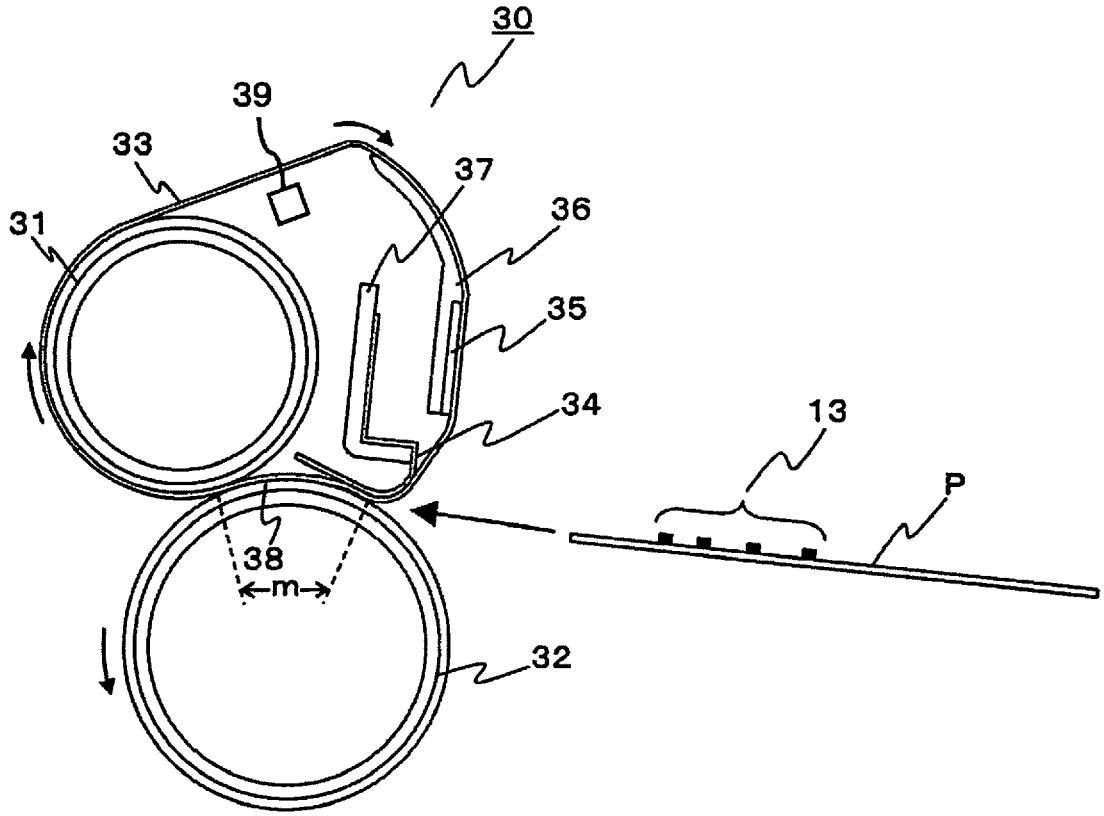
FIG. 1 is a configuration diagram schematically illustrating a fixation device shown in FIG. 2 according to a first embodiment of the invention.

Descriptions are provided herein below for embodiments based on the drawings. In the respective drawings referenced herein, the same constituents are designated by the same reference numerals and duplicate explanation concerning the same constituents is omitted. All of the drawings are provided to illustrate the respective examples only.

[First Embodiment]

(Configuration of First Embodiment)

Figure 2A:
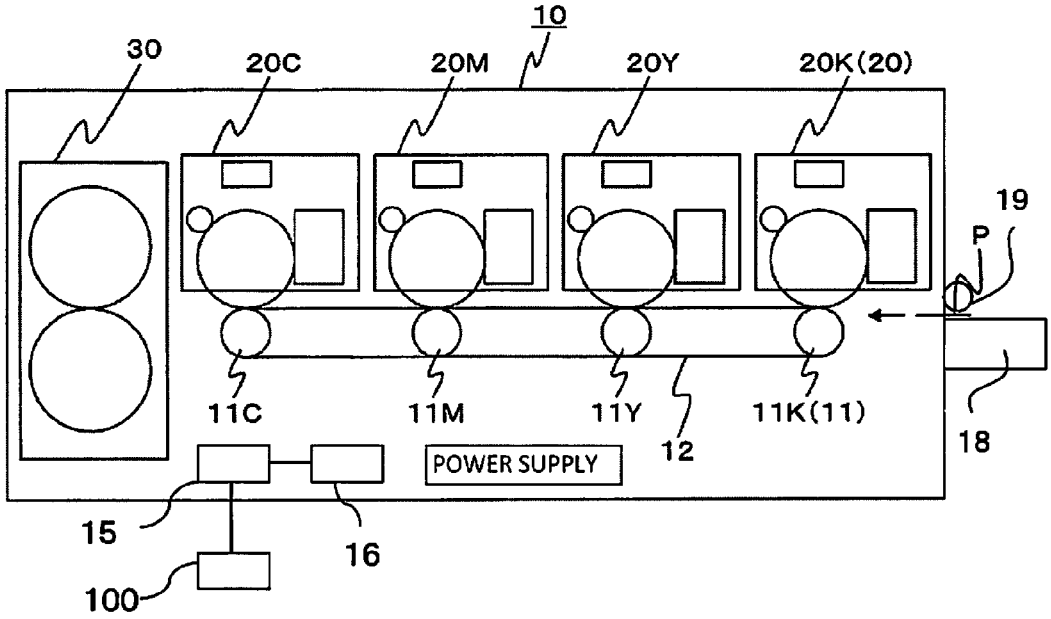
FIGS. 2A and 2B are configuration diagrams schematically illustrating an image formation apparatus according to the first embodiment of the invention.
Figure 2B:
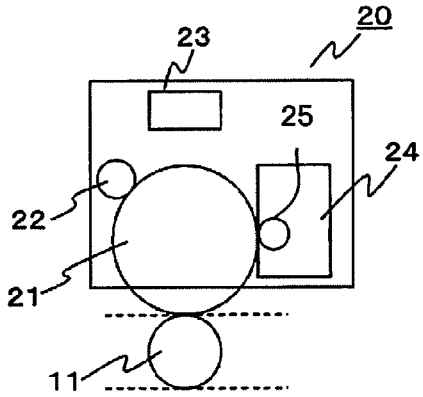

FIGS. 2A and 2B are configuration diagrams schematically illustrating image formation apparatus 10 according to the first embodiment of the invention, wherein FIG. 2A is an overall view of the configuration of image formation apparatus 10 and FIG. 2B is a partial enlarged view illustrating image formation unit 20 and image transfer roller 11.

Image formation apparatus 10 is an electrophotographic page printer in the first embodiment. Image formation apparatus 10 has conveyance belt 12 to convey recording medium P such as paper sheets at predetermined times. Image formation units 20 (20K, 20Y, 20M, and 20C) to develop toner images of respective colors of black (K), yellow (Y), magenta (M), and cyan (C) are provided above conveyance belt 12.

Image transfer rollers 11 (11K, 11Y, 11M, and 11C) or an image transfer device(s) are provided below image formation units 20 and in conveyance belt 12 such that image transfer rollers 11 and image formation units 20 sandwich conveyance belt 12 therebetween. Each of image transfer rollers 11 functions to transfer a toner image serving as a developer image formed by image formation unit 20 onto sheet P, by generating an electrical field between image formation unit 20 and image transfer roller 11. Image formation units 20, conveyance belt 12, and image transfer rollers 11 make up an image formation section. Fixation device 30 is provided downstream of image formation unit 20C in the direction of conveyance of sheet P (the sheet conveyance direction).

Each image formation unit 20 includes an image carrier (for example, photosensitive drum 21), a charging device (for example, charging roller 22), a latent image formation device or an optical exposure device (for example, recording head 23), and a development unit (for example, development device 24).

Photosensitive drum 21 functions to carry thereon an electrostatic latent image and a developer image (for example, toner image) developed by supplying developer (for example, toner) to the electrostatic latent image. Charging roller 22 is configured to charge the surface of photosensitive drum 21. Recording head 23 is configured to form an electrostatic latent image on the charged surface of photosensitive drum 21. Development device 24 functions to form a toner image as a visible image by supplying toner to the electrostatic latent image on the surface of photosensitive drum 21.

FIG. 1 is a configuration diagram schematically illustrating fixation device 30 shown in FIG. 2 according to the first embodiment of the invention.

Fixation device 30 functions to fix toner 13 (the toner image) to sheet P by heating and pressing sheet P on which toner 13 is attached. Fixation device 30 includes: fixation roller 31 serving as a first sandwiching member rotatably disposed; pressure roller 32 serving as a pressure member rotatably disposed facing fixation roller 31; and fixation belt 33 serving as a conveyance member to be rotated with the rotation of fixation roller 31. Fixation belt 33 is wound around fixation roller 31, nip formation member 34 supported by support body 37, and a heater, which are provided inside fixation belt 33.

The heater includes sheet heating element 35 and support body 36 for sheet heating element 35, for example. Sheet heating element 35 is disposed such that sheet heating element 35 and support body 36 are in press contact with the inner circumferential surface of fixation belt 33. The pressure at which support body 36 is pressed against fixation belt 33 is set to a value of approximately 2 Kg-f at most, in order not to deteriorate the sliding performance between support body 36 and fixation belt 33.

Pressure roller 32 provided outside fixation belt 31 is in press contact with the outer circumferential surface of fixation roller 31 such that pressure roller 32 is pressed against fixation roller 31 and nip formation member 34 provided inside fixation belt 31 via fixation belt 33, thereby forming nip 38 having a length of m. Nip 38 includes a first nip section formed between fixation roller 31 and pressure roller 32 which are pressed against each other at a first pressure and a second nip section formed between nip formation member 34 and pressure roller 32 which are pressed against each other at a second pressure smaller than the first pressure. Temperature detector 39 may be provided in contact with the inner circumferential surface or the outer circumferential surface of fixation belt 33, or may be provided facing the inner circumferential surface or the outer circumferential surface of fixation belt 33 with a small gap therebetween.

As binder resin in toner 13, polystyrene, styrene-propylene copolymer, styrene-vinylnaphthalene copolymer, styrene-methyl acrylate copolymer, polyester type copolymer, polyurethane type copolymer, epoxy type copolymer, aliphatic, alicyclic type hydrocarbon resin, aromatic type petroleum resin, or the like may be used, or a mixture of two or more of them may be used. Toner 13 may contain wax in order to prevent an offset phenomenon occurring upon fixation, and polyethylene wax, propylene wax, carnauba wax, ester series, or the like may be used as such wax.

Figure 3A:
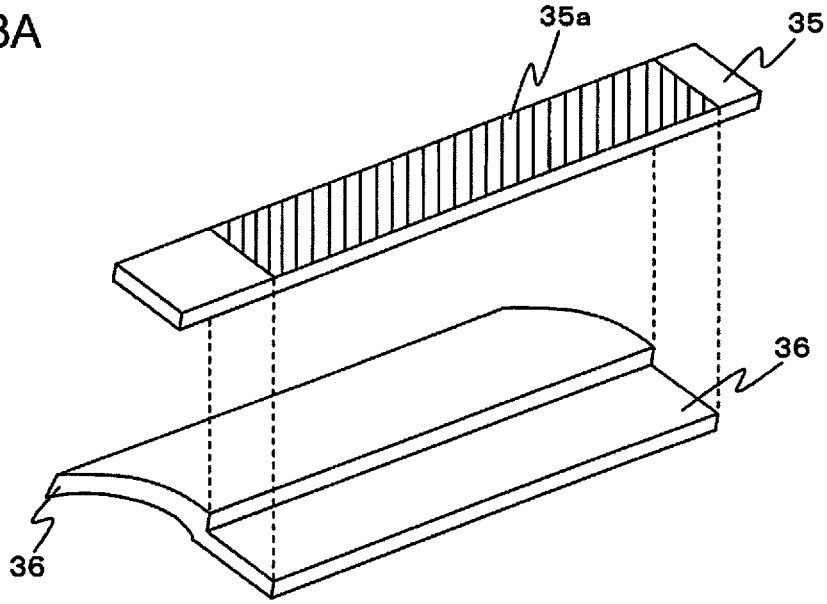
FIGS. 3A and 3B are perspective views illustrating a sheet heating element and a support body supporting the sheet heating element shown in FIG. 1.
Figure 3B:
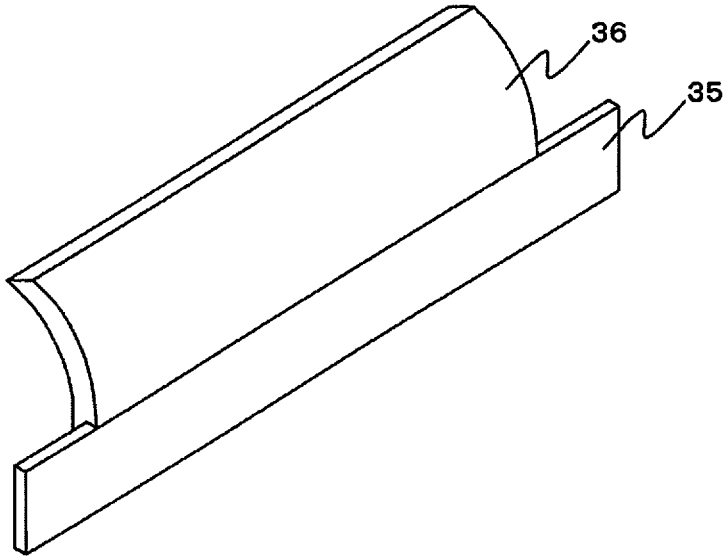

FIGS. 3A and 3B are perspective views illustrating sheet heating element 35 and support body 36 supporting sheet heating element 35 shown in FIG. 1.

FIG. 3A is an exploded perspective view illustrating a state before sheet heating element 35 and support body 36 are integrated and FIG. 3B is a perspective view illustrating a state where sheet heating element 35 and support body 36 are integrated. Note that, in FIG. 3A, the shaded area in sheet heating element 35 is a heating area.

Support body 36 is made of any one of: a metal having high heat conductivity and high workability such as aluminum or copper; an alloy that contains any of such metals as a main component; and any of iron, an iron alloy, stainless steel and the like having high heat resistance and high rigidity. Support body 36 and sheet heating element 35 are integrated with each other by pressing against fixation belt 33 and are to be in sliding contact with fixation belt 33 upon rotation of fixation belt 33. Sheet heating element 35 is a ceramic heater, a stainless steel heater, or the like, and a surface thereof, to be in contact with the inner surface of fixing belt 33, is formed either in a flat or arc shape.

Figure 4:
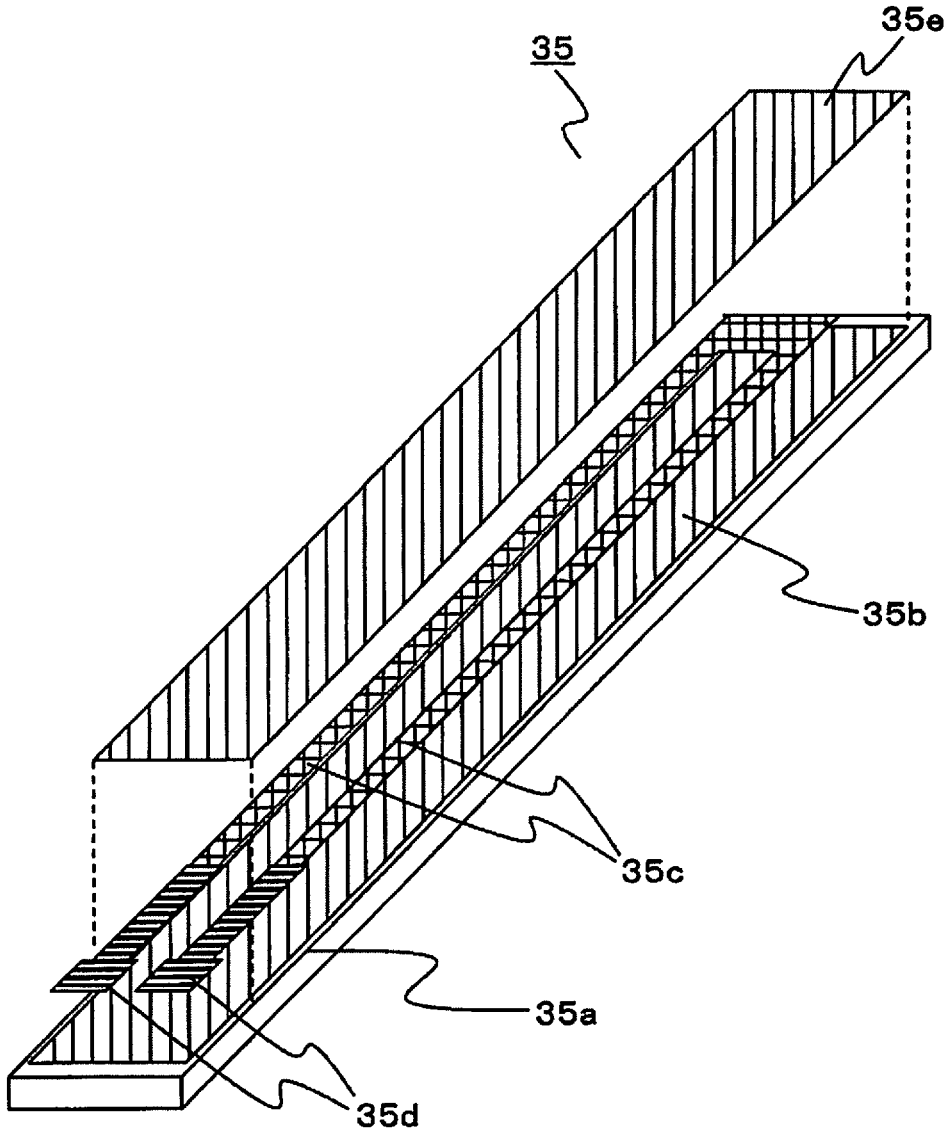
FIG. 4 is an exploded perspective view of the sheet heating element shown in FIG. 3.

FIG. 4 is an exploded perspective view of sheet heating element 35 shown in FIG. 3.

As shown in FIG. 4, electric insulating layer 35*b* such as a thin glass membrane is formed on base plate 35*a* made of SUS430 stainless steel or the like. Resistance heating element 35*c* is formed on electric insulating layer 35*b* by applying a paste of nickel-chromium alloy powder or silver-palladium alloy powder on electric insulating layer 35*b* by screen printing.

Electrodes 35*d*, which are made of a chemically-stable metal having a low electric resistance such as silver or a high melting point metal such as tungsten, is formed at each end of resistance heating element 35. Protective layer 35*e*, which is made of glass or a typical fluorine containing resin such as polytetrafluoroethylene (PTFE), perfluoro-alkoxyalkane (PFA), or fluorinated ethylene propylene copolymer (FEP), is formed on resistance heating element 35*c* and electrodes 35*d*. Here, sheet heating element 35 is configured such that the surface to be in contact with the inner circumferential surface of fixation belt 33 may be either a first surface of sheet heating element 35 where resistance heating element 35*c* is provided or a second surface of sheet heating element 35 opposite to the first surface.

Figure 5:
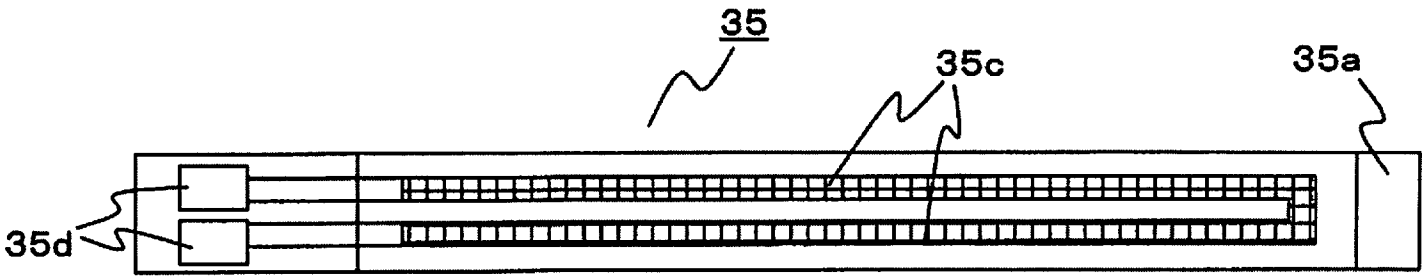
FIG. 5 is a plan view illustrating an upper surface of the sheet heating element of FIG. 4.

FIG. 5 is a plan view illustrating an upper surface of sheet heating element 35 of FIG. 4. In FIG. 5, electrodes 35*d* are formed on base plate 35*a* at the left end portion of sheet heating element 35 and resistance heating element 35*c* is formed on base plate 35*a* between the left and the right end portions.

Figure 6:
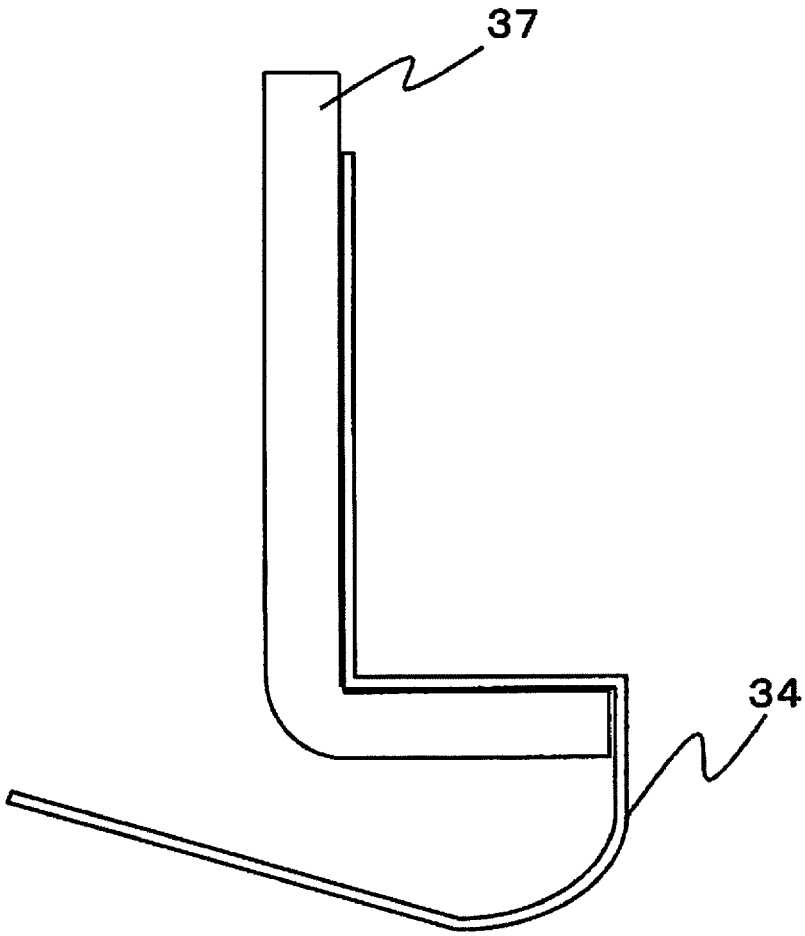
FIG. 6 is a side view illustrating a nip formation member and a support body supporting the nip formation member shown in FIG. 1.

FIG. 6 is a side view illustrating nip formation member 34 and support body 37 supporting nip formation member 34 shown in FIG. 1. Support 37 is formed of sheet metal having an L-shape as viewed laterally. A part of nip formation member 34 is bent along the L-shape of support body 37, combined with and supported by support body 37, and fixed to support body 37 by means of a screw(s), bond, weld, or the like. The rest of nip formation member 34 is bent around the short side of L-shaped support body 37, forming a sliding surface which is to be in sliding contact with fixation belt 33.

Nip formation member 34 is made of one of iron, stainless, steel, and aluminum, or made of an alloy containing one or more of them. The sliding surface of nip formation member 34 which is to be in sliding contact with fixation belt 33 may be coated with a low friction coefficient material such as a fluorine type coating, silicon type coating, or the like.

Nip formation member 34 has a thickness of approximately from 0.05 mm to 0.5 mm to produce elasticity or spring performance, and the length and the thickness of nip formation member 34 are designed to have a required load and a required deformation amount. Support 37 may be sheet metal made of iron, stainless steel, aluminum, or the like, or may be a high-temperature resin such as polyphenylene sulfide (PPS), liquid-crystal polymer (LCP), polyether ether ketone (PEEK), or the like.

Figure 7A:
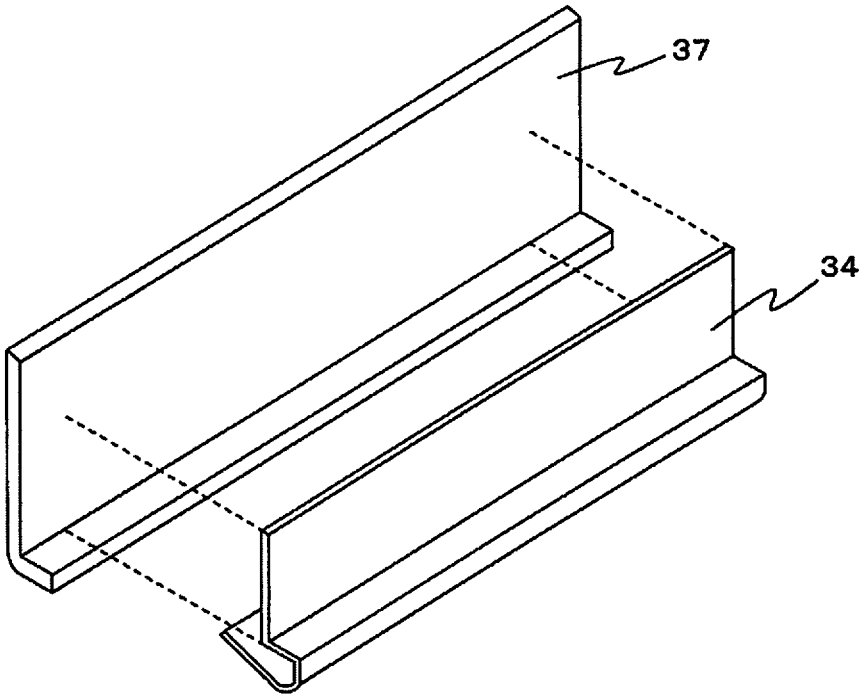
FIGS. 7A and 7B are perspective views illustrating the nip formation member and the support body supporting the nip formation member shown in FIG. 1.
Figure 7B:
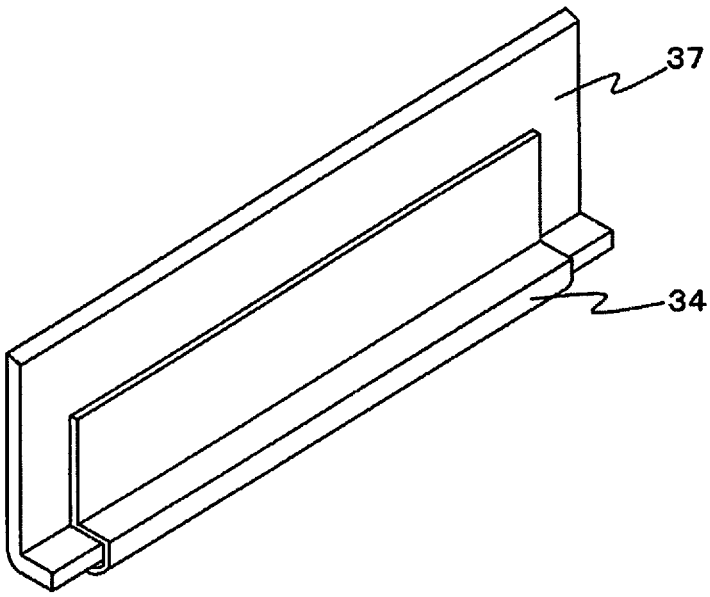

FIGS. 7A and 7B are perspective views illustrating nip formation member 34 and support body 37 shown in FIG. 1.

FIG. 7A is an exploded perspective view illustrating a state before support body 37 and nip formation member 34 are integrated with each other. FIG. 7B is a perspective view illustrating a state where support body 37 and nip formation member 34 are integrated with each other.

Support 37 is formed of metal sheet having a L-shaped as viewed laterally, as described above. Nip formation member 34 includes: a fixed portion (a L-shaped portion) which is bent along and fixed to L-shaped support body 37; and an elastic portion (an extension) which extends from the tip of the fixed portion (the L-shape portion) and is bent around the short side of L-shaped support body 37.

Figure 8:
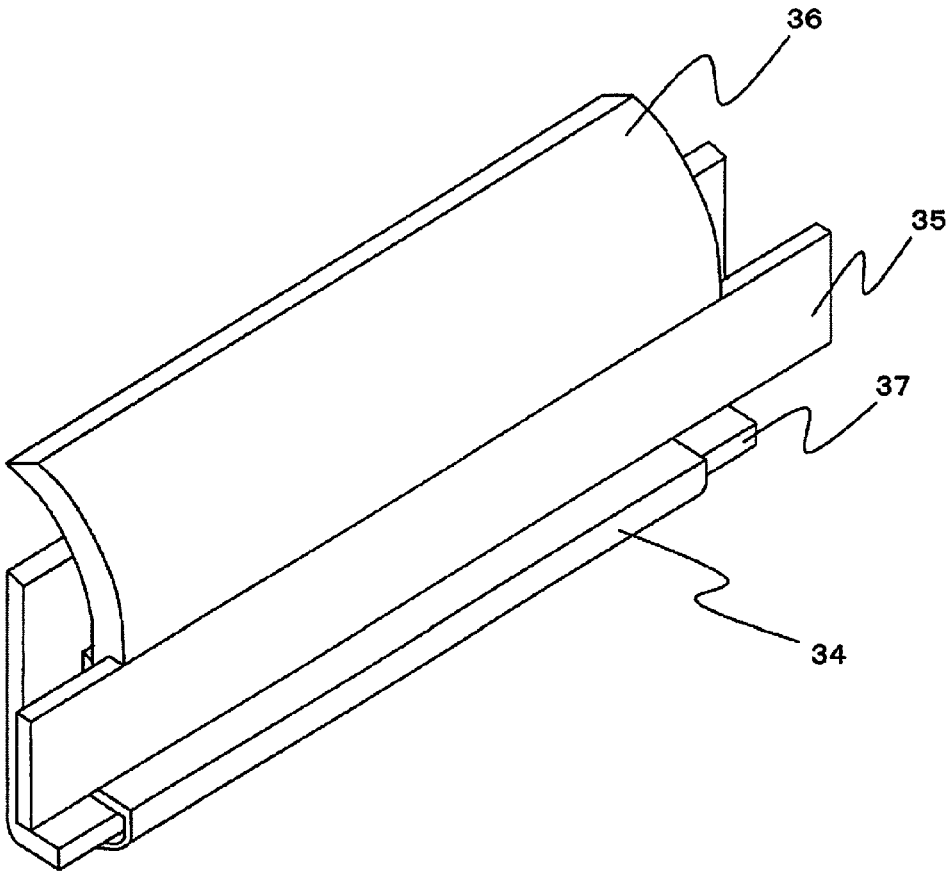
FIG. 8 is a perspective view illustrating a positional relationship among the sheet heating element, the nip formation member, and etc. shown in FIG. 1.

FIG. 8 is a perspective view illustrating the positional relationship among sheet heating element 35, support body 36, support body 37, and nip formation member 34 shown in FIG. 1.

Nip formation member 34 is fit to and combined with support body 37 for nip formation member 34. Sheet heating element 35 is provided slightly above nip formation member 34 and is combined with support body 36 by being pressed against fixation belt 33.

Figure 9:
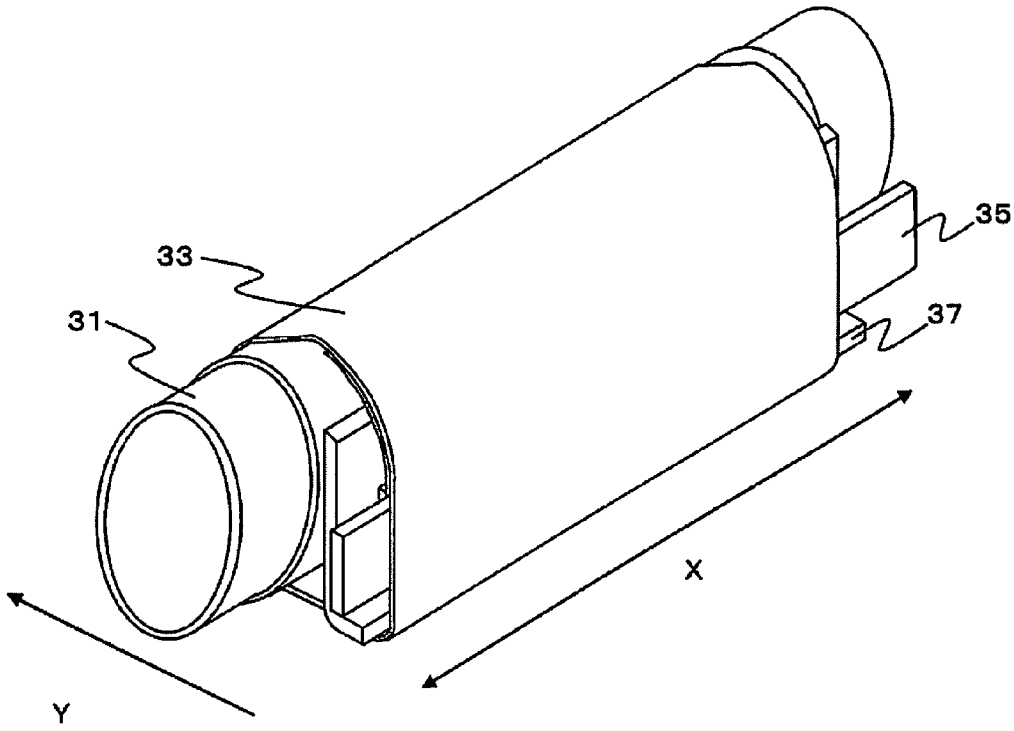
FIG. 9 is a perspective view illustrating a state where components are set in a fixation belt shown in FIG. 1.

FIG. 9 is a perspective view illustrating the state where the components are accommodated in fixation belt 33 shown in FIG. 1.

FIG. 9 illustrates fixation roller 31, sheet heating element 35, and support body 37 for nip formation member 34 in fixation belt 33. Support body 36 for sheet heating element 35 and nip formation member 34 are also provided in fixation belt 33 but cannot be seen in FIG. 9 because they are hidden in fixation belt 33.

Figure 10B:
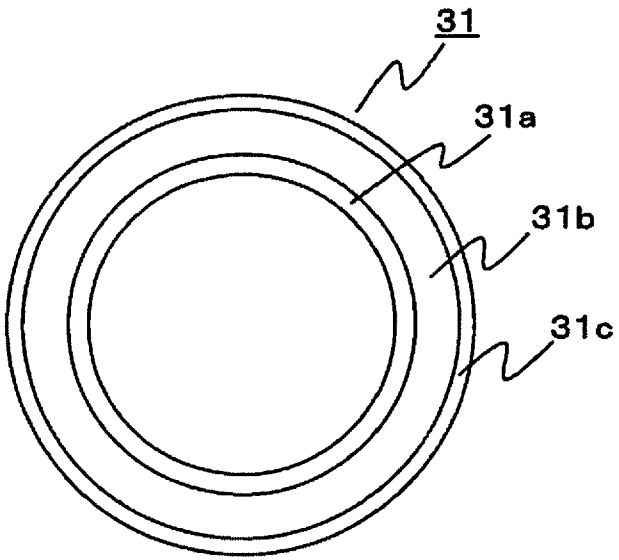
FIGS. 10A and 10B are sectional views of a fixation roller shown in FIG. 1.
Figure 10A:
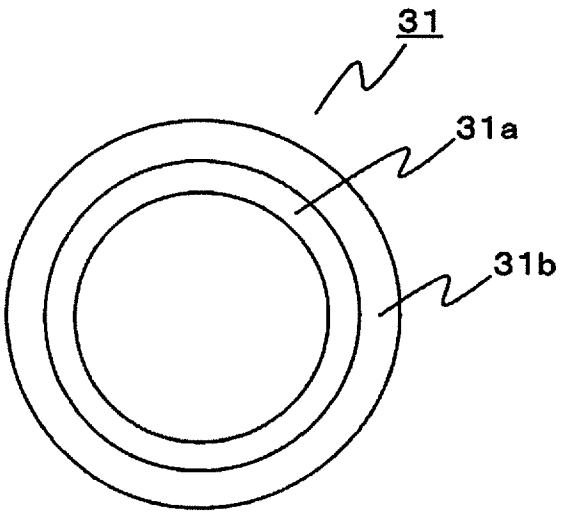

FIGS. 10A and 10B are sectional views of fixation roller 31 shown in FIG. 1. Fixation roller 31 includes core metal 31*a* and elastic layer 31*b* as shown in FIG. 10A. Fixation roller 31 may include release layer 31*c* on elastic layer 31*b* as shown in FIG. 10B.

Core metal 31*a* is formed of a metal pipe or shaft made of aluminum, iron, stainless, or the like, to maintain constant rigidity. Elastic layer 31*b* is made of high heat-resistant rubber such as general silicon rubber, sponge silicon rubber, fluorine-contained rubber, or the like. Note that pressure roller 32 has the same cross-section structure as that of fixation roller 31.

Figure 11A:
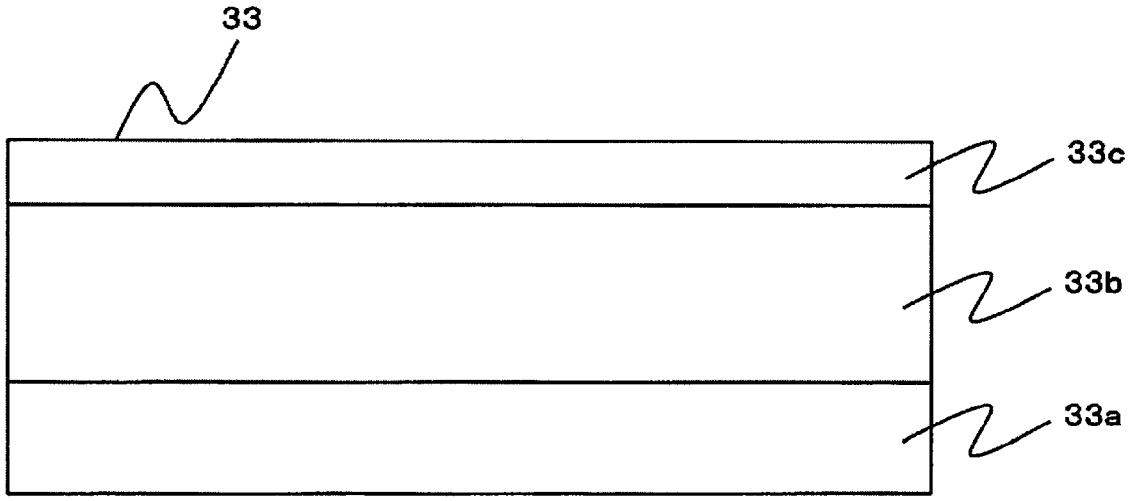
FIGS. 11A and 11B are sectional views of the fixation belt shown in FIG. 1.
Figure 11B:
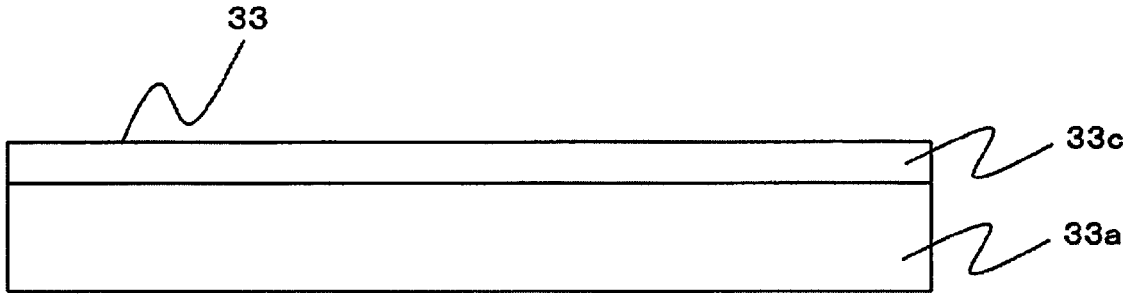

FIGS. 11A and 11B are sectional views of fixation belt 33 shown in FIG. 1. As shown in FIG. 11A, fixation belt 33 includes base 33*a*, elastic layer 33*b* formed on base 33*a*, release layer 33*c* formed on elastic layer 33*b*. As shown in FIG. 11B, fixation belt 33 may have release layer 33*c* on base 33*a*.

Base 33*a* is made of, for example, nickel, polyimide, stainless, or the like and preferably has a thickness of 30 to 150 μm to have a good balance between stiffness and friction performance. Elastic layer 33*b* is made of thin silicon rubber preferably having a thickness of 50 to 300 μm to have a good balance between low hardness and high thermal conductivity or is made of thin fluorine-containing resin preferably having a thickness of 10 to 50 μm to have wear resistance and high thermal conductivity.

Fixation belt 33 is wound around fixation roller 31 and support body 36 such that release layer 33*c* of fixation belt 33 faces out. Like release layer 31*c*, release layer 33*c* is made of a resin having high heat resistance and low surface free energy after shaping. For example, release layer 33*c* is made of a typical fluorine-based resin such as polytetrafluoroethylene (PTFE), perfluoroalcoxy alkane (PFA) or perfluoroethylene-propene copolymer (FEP) having a thickness of preferably from 10 to 50 [μm].

(General Operation of Image Formation Apparatus of the First Embodiment)

The overall operation of image formation apparatus 10 will be described with reference to FIG. 2.

Sheets P set in sheet cassette 18 are fed to image formation units 20 by pickup roller 19. In each image formation unit 20, the surface of photosensitive drum 21 is uniformly charged by charging roller 22. A print job received from host computer 15 or an external apparatus by communication unit 15 is sent to recording heads 23 in image formation units 20 via controller 16. Recording head 23 forms an electrostatic latent image on photosensitive drum 21 according to a print pattern based on the print job.

Development device 24 is equipped with development roller 25. Development roller 25, which is in contact with photosensitive drum 21, attaches toner 13 to the electrostatic latent image on photosensitive drum 21, thereby forming a toner image on photosensitive drum 21. After that, toner (toner image) 13 on photosensitive drum 21 is transferred onto sheet 14 by means of an electric field between photosensitive drum 21 and image transfer roller 11. Toner 13 on sheet P is fixed to sheet P by fixation device 30, and then sheet P is discharged out of the apparatus by unillustrated conveyance rollers or the like.

(Operation of Fixation Device According to First Embodiment)

In FIG. 1, fixation belt 33 is driven by pressure roller 32 to rotate in a direction indicated by the arrow in FIG. 1 as fixation belt 33 is in sliding contact with support body 36, sheet heating element 35, and nip formation member 34. Since sheet heating element 35 is energized, fixation belt 33 is heated at the contact between fixation belt 33 and sheet heating element 35. Temperature detector 39 detects the surface temperature of fixation belt 33 and controller 16 controls the power applied to sheet heating element 35 based on the detected surface temperature so as to maintain the surface temperature of fixation belt 33 to the appropriate temperature. Sheet P having toner 13 thereon is conveyed through nip 38, which is formed by pressing pressure roller 32 against fixation roller 31 and nip formation member 34 via fixation belt 33, so that sheet P is heated by fixation belt 33 and pressed by pressure roller 32, thereby fixing toner 13 onto sheet P.

(Effect of First Embodiment)

The fixation device and the image formation apparatus according to the first embodiment achieve the following effects (1) to (4).

Figure 12:
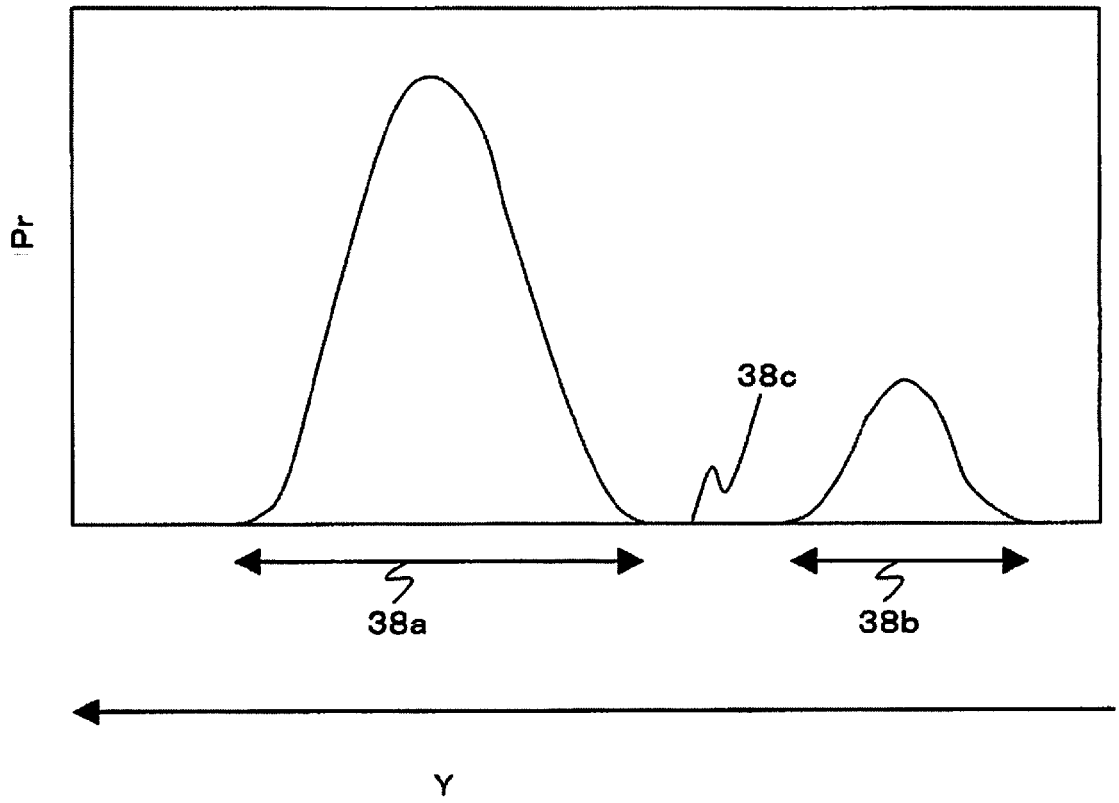
FIG. 12 is a graph showing the pressure distribution in the nip of the fixation device of FIG. 1.

(1): FIG. 12 is a graph showing the pressure distribution in nip 38 of fixation device 30 of FIG. 1.

In FIG. 12, the horizontal axis shows sheet conveyance direction Y and the vertical axis shows pressure Pr. Sheet conveyance direction Y in FIG. 12 corresponds to sheet conveyance direction Y shown in FIG. 9. In terms of the pressure distribution, nip 38 includes three sections comprising: first nip section 38*a* (for example, the area corresponding to the fixation roller) formed by having fixation roller 31 pressed against pressure roller 32 at a first pressure; second nip section 38*b* (for example, the area corresponding to the nip formation member) formed by having nip formation member 34 pressed against pressure roller 32 at a second pressure which is smaller than the first pressure; and pressure drop section 38*c* between first nip section 38*a* and second nip section 38*b*.

Accordingly, the pressure distribution in nip 38 according to the first embodiment is much longer than in the case where a nip is formed between fixation roller 31 and pressure roller 32 without nip formation member 34. Therefore, the first embodiment transfers much more heat to sheet P passing through nip 38, so that the first embodiment lowers the temperature of fixation belt 33 or permits faster printing speed.

(2): According to the first embodiment, the first pressure in first nip section 38*a* (the area corresponding to the fixation roller) is set greater than the second pressure in the second nip section 38*b* (the area corresponding to the nip formation member) which is provided downstream of first nip section 38*a*. That is, the pressure applied to toner 13 on sheet P is greater in the vicinity of the exit of nip 38 than that in the vicinity of the entrance of nip 38. Therefore, toner 13 is effectively, efficiently fixed to sheet P. The reason will be described below.

Toner 13 is made of resin and thus has the property that it gets softer as the temperature increases. At second nip section 38*b*, which is the area in the vicinity of the entrance (the upstream end portion) of nip 38 in sheet conveyance direction Y, toner 13 on sheet P is not yet sufficiently heated and has a low temperature. On the other hand, at first nip section 38*a*, which is the area in the vicinity of the exit (the downstream end portion) of nip 38 in sheet conveyance direction Y, toner 13 on sheet P is sufficiently heated and pressed at a relatively-high pressure, so that toner 13 is effectively and fixed on sheet P.

Since fixation belt 33 is rotatably driven while being in sliding contact with the sliding contact surface of nip formation member 34, if the second pressure in second nip section 38*b* is set to a high pressure, the coefficient of sliding friction becomes high so that the driving torque to rotate fixation belt 33 has to be increased. To prevent the increased driving torque, the first embodiment sets the second pressure in second nip section 38*b* relatively low.

(3): In the first embodiment, nip formation member 34 is formed of a metal member having a spring property. This prevents a temporal change of the pressure distribution in nip 38, thereby maintaining the pressure distribution shown in FIG. 12 nearly constant. The temporal change of the pressure distribution will be described in detail below.

Figure 13:
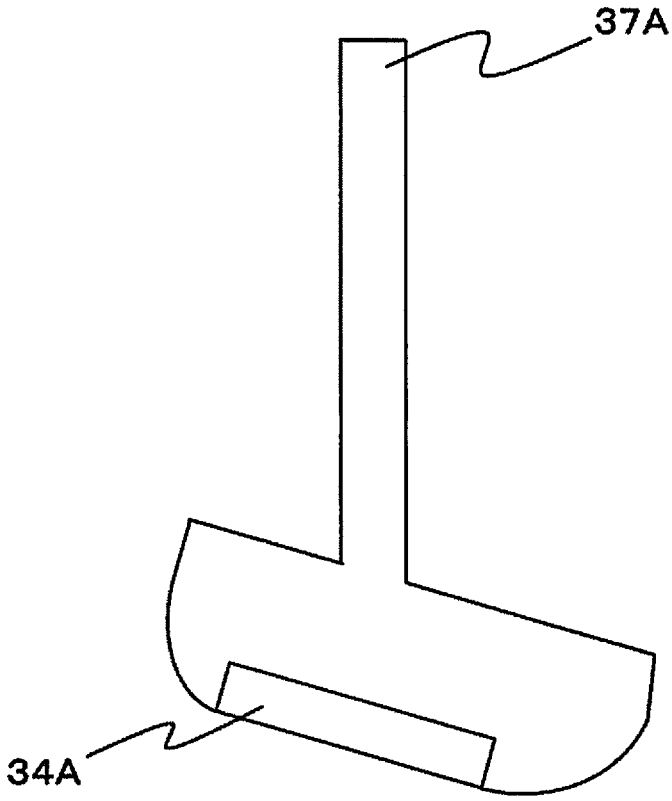
FIG. 13 is a perspective view of a comparison example of a nip formation member and a support body supporting the nip formation member to be compared with those shown in FIG. 6.

FIG. 13 is a perspective view of a comparison example of the nip formation member and the support body supporting the nip formation member to be compared with nip formation member 34 and support body 37 shown in FIG. 6.

Nip formation member 34 shown in FIG. 6 may be made of resin, rubber, or the like. However, if nip formation member 34A according to the comparison example shown in FIG. 13 is made of, for example, resin, nip formation member 34 may be deformed by heat over time, making it difficult to maintain dimensional accuracy.

If nip formation member 34A is made of, for example, rubber having low hardness, the above problem caused by the temporal deformation of the resin does not occur, but the hardness of nip formation member 34A varies over time and makes it difficult to maintain the pressure distribution constant since low hardness conflicts with high heat resistance, low creep characteristics, or the like in general.

Figure 14:
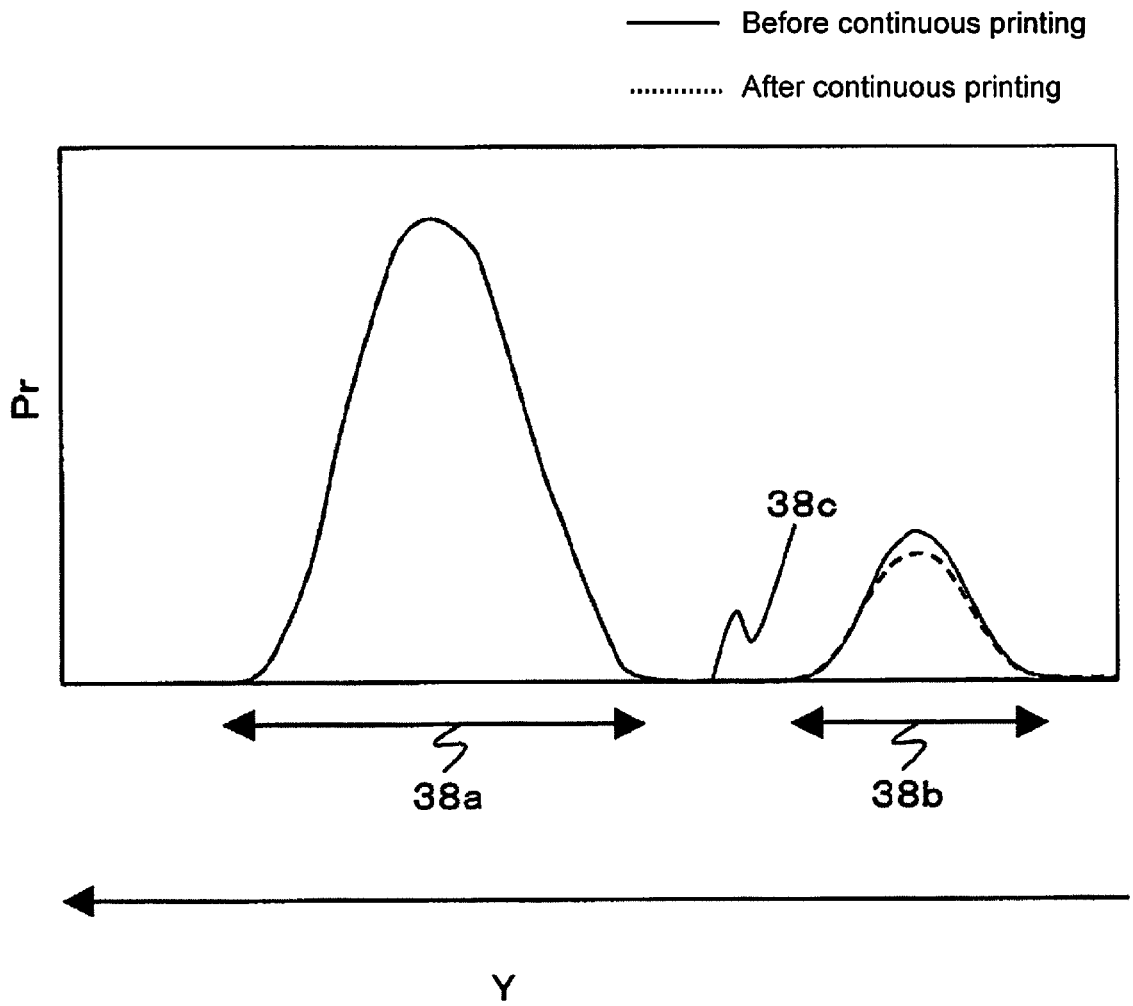
FIG. 14 is a graph showing the pressure distribution in the nip in the case where the nip formation member of FIG. 13 is equipped in the fixation device of FIG. 1.

FIG. 14 is a graph showing the pressure distribution in nip 38 in the case where nip formation member 34A of FIG. 13 is equipped in fixation device 30 of FIG. 1.

In FIG. 14, the horizontal axis shows sheet conveyance direction Y and the vertical axis shows pressure Pr. FIG. 14 is a graph to compare the pressure distribution before continuous printing of a total of 10000 sheets with the pressure distribution after such continuous printing of total 10000 sheets in the case where nip formation member 34A shown in FIG. 13 is made of silicon rubber. In FIG. 14, the solid line shows the pressure distribution before the continuous printing and the broken line shows the pressure distribution after the continuous printing. As shown in FIG. 14, variation of the pressure distribution in second nip section 38*b* occurs due to the continuous printing.

Figure 15:
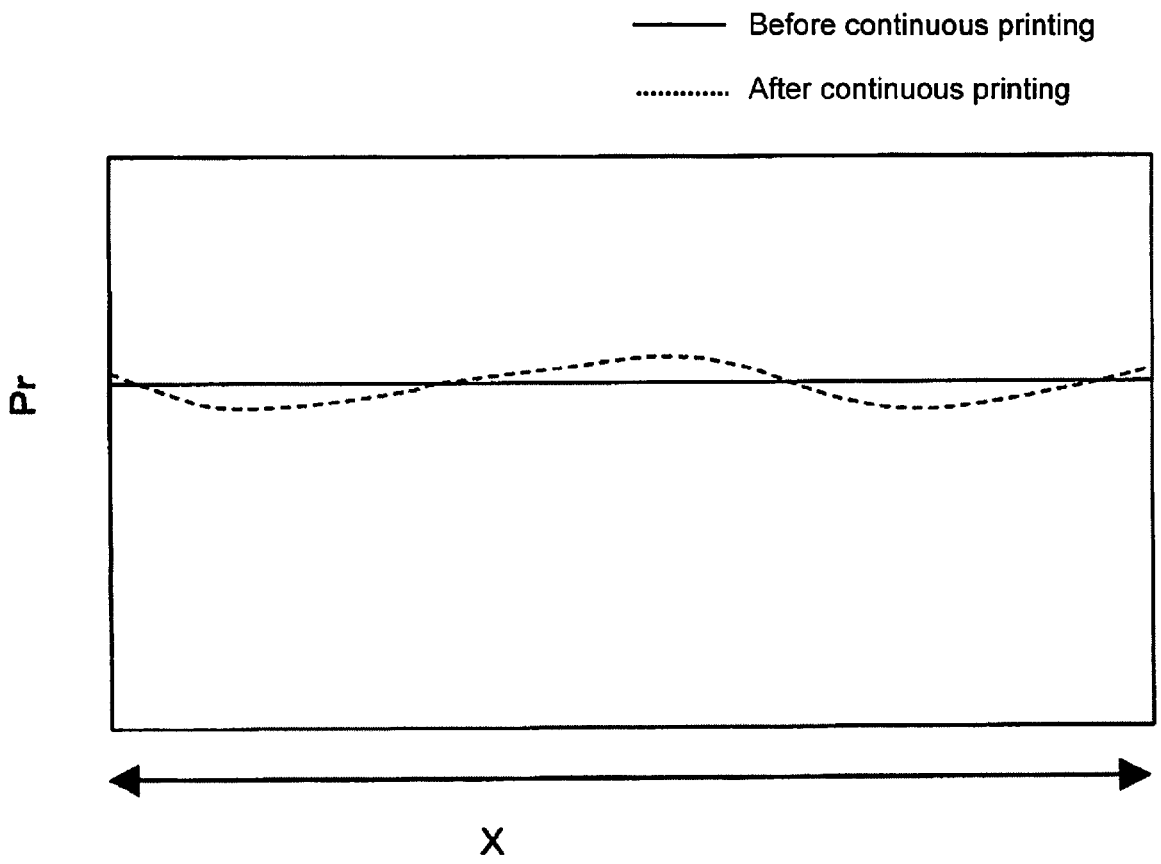
FIG. 15 is a graph showing the pressure distribution along a longitudinal direction (see FIG. 9) in the nip in the case where the nip formation member of FIG. 13 is equipped in the fixation device of FIG. 1.

FIG. 15 is a graph showing the pressure distribution along longitudinal direction X (see, FIG. 9) in nip 38 in the case where nip formation member 34A of FIG. 13 is equipped in fixation device 30 of FIG. 1.

In FIG. 15, the horizontal axis shows longitudinal direction X and the vertical axis shows pressure Pr. In FIG. 15, the solid line shows the pressure distribution before the continuous printing and the broken line shows the pressure distribution after the continuous printing. Due to the continuous printing, the pressure distribution along longitudinal direction X in nip 38 is changed as shown in FIG. 15. That is, as shown in FIG. 14 and FIG. 15, both the pressure distribution in sheet conveyance direction Y and the pressure distribution in longitudinal direction X are changed after the continuous printing, in the case where nip formation member 34A is made of an elastic body such as silicon rubber or the like.

In the continuous printing of the 10000 sheets, an unillustrated temperature sensor detects the surface temperature of fixation belt 33 at the exit of the nip, controller 16 controls the power supplied to the heater based on the detected temperature such that the surface temperature of fixation belt 33 is maintained at 140° C. Note that the experiment of the continuous printing is performed with the following conditions.

Fixation Belt 33
- Inner diameter: 45 mm
- Base 33*a*: polyimide (80 μm thick)
- Elastic layer 33*b*: silicon rubber (150 μm thick)
- Release layer 33*c*: PFA (30 μm thick)

Fixation Roller 31
- Diameter: 25 mm
- Elastic layer 31*b*: silicon sponge (1.2 mm), 77 on the ASKERC scale
- Pressing force: 20 kg-f Nip Formation Member 34
- Plate spring: SUS304, 0.5 mm thickness
- Pressing force: 7 kg-f Pressure roller 32
- Diameter: 36 mm
- Elastic layer 31*b*: silicon rubber (1.2 mm thickness), 82 on the ASKERC scale
- Release layer 31*c*: PFA (30 μm thickness)

Sheet Heating Element 35

Stainless heater: 20 mm width, 850 Watts

Pressing load: 1.0 kg-f

Toner 13

Polystyrene toner, yellow, magenta, cyan, 15 weight parts of wax

Sheet P 64 g/m2, A4 size, portrait orientation

Amount of transferred toner: 1.5±0.1 g/sheet

Sheet conveyance speed: 240 mm/s (4): Image formation apparatus 10 according to the first embodiment includes the fixation device according to the first embodiment. Therefore, image formation apparatus 10 can achieve an electric power saving by lowering the temperature of fixation belt 33 or can enable a faster printing speed without lowering the temperature of fixation belt 33.

(Modifications of First Embodiment)

Figure 16:
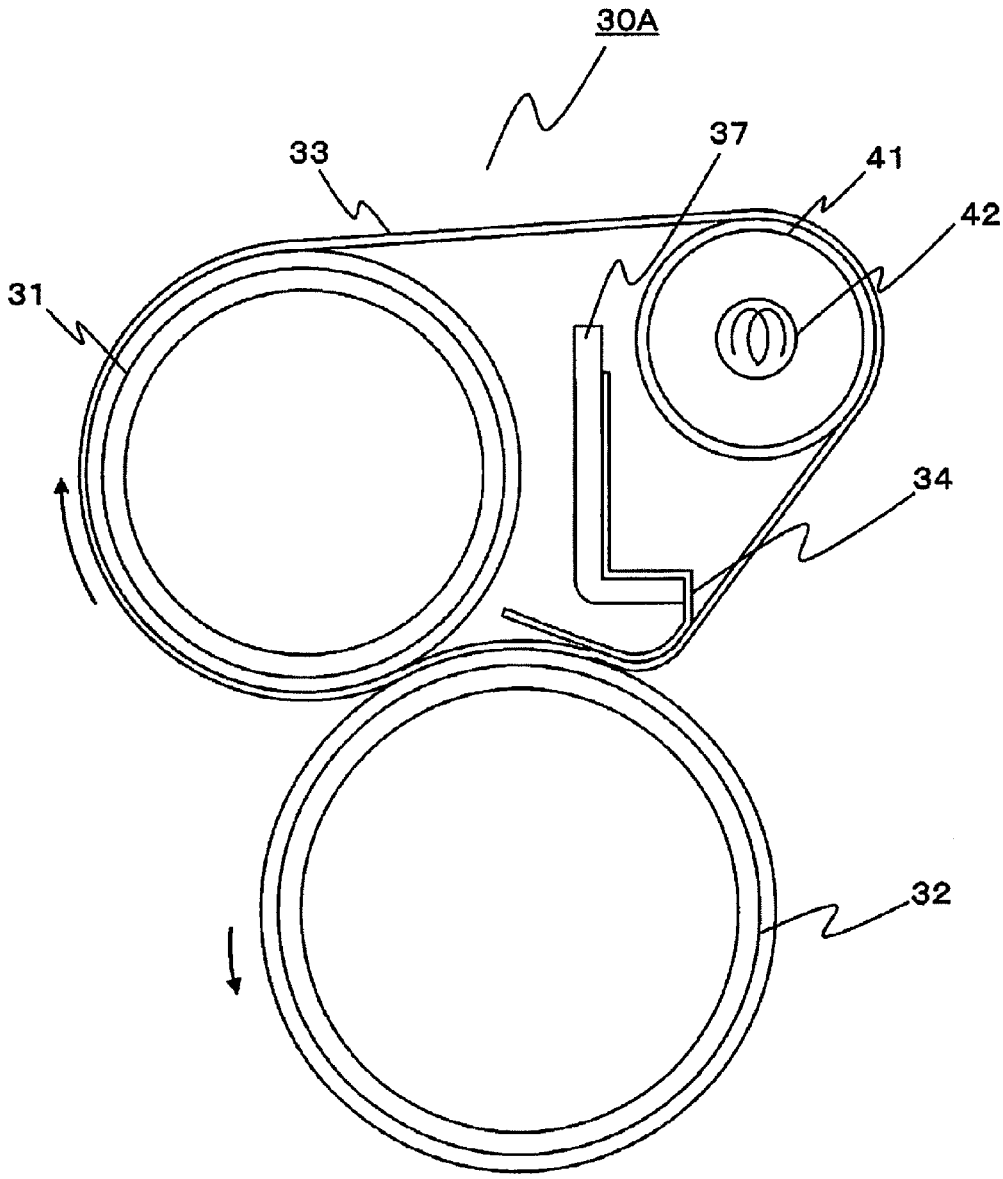
FIG. 16 is a configuration diagram schematically illustrating a first modification of the fixation device of FIG. 1.

FIG. 16 is a configuration diagram schematically illustrating a first modification of fixation device 30 of FIG. 1. In FIG. 16, the same configurations as the first embodiment of FIG. 1 are designated by the same reference numerals.

Fixation device 30A shown in FIG. 16 has almost the same configuration as that of fixation device 30 shown in FIG. 1 but includes heat roller 41 having therein heat source 42 instead of sheet heating element 35. Heat roller 41 is formed of a hollow pipe made of iron, stainless, aluminum, copper, or the like. Heat source 42 is, for example, a halogen lamp.

Figure 17:
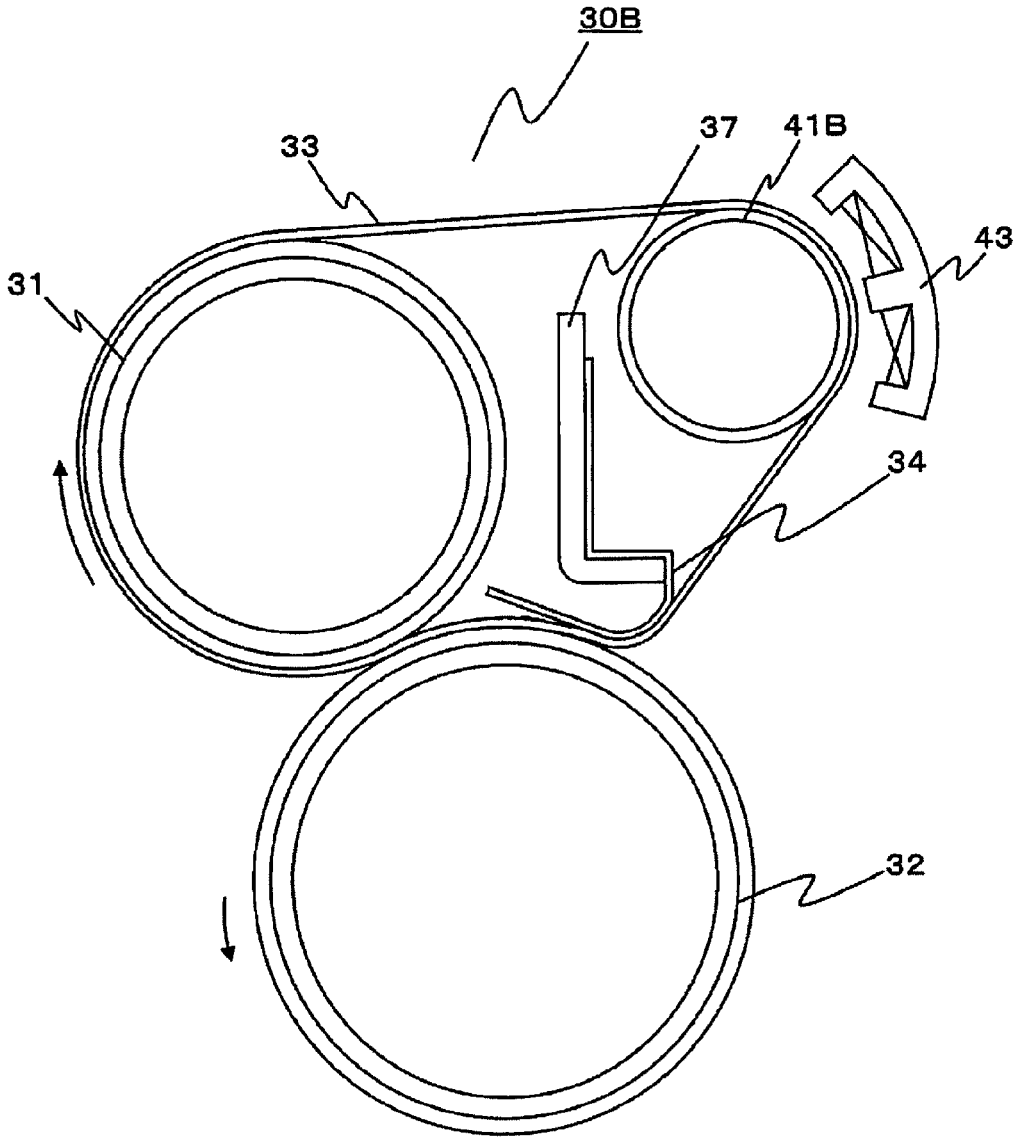
FIG. 17 is a configuration diagram schematically illustrating a second modification of the fixation device of FIG. 1.

FIG. 17 is a configuration diagram schematically illustrating a second modification of fixation device 30 of FIG. 1. In FIG. 17, the same configurations as the first embodiment of FIG. 1 are designated by the same reference numerals.

Fixation device 30B shown in FIG. 17 has almost the same configuration as that of fixation device 30 shown in FIG. 1 but includes roller 41B and magnetic field generator 43 facing roller 41B with fixation belt 33 between roller 41B and magnetic field generator 43. Magnetic field generator 43 has an unillustrated magnetizing coil to heat roller 41B and fixation belt 33 by electromagnetic induction.

In the case where fixation device 30B has magnetic field generator 43 as shown in FIG. 17, base 33*a* of fixation belt 33 is made of polyimide or the like kneaded with conductive filler such as nickel, stainless, silver, aluminum, or the like.

[Second Embodiment]

(Configuration of Second Embodiment)

Figure 18:
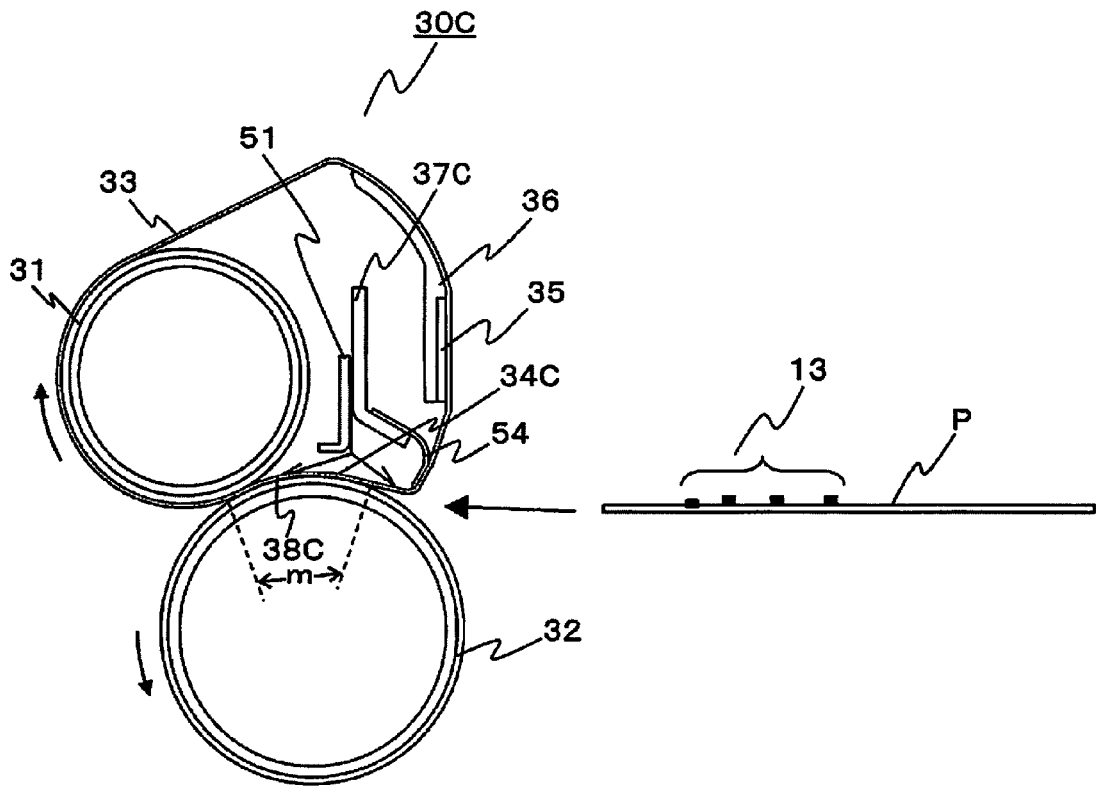
FIG. 18 is a configuration diagram schematically illustrating a fixation device according to a second embodiment of the invention.

FIG. 18 is a configuration diagram schematically illustrating fixation device 30C according to the second embodiment of the invention. In FIG. 18, the same configurations as the first embodiment of FIG. 1 are designated by the same reference numerals.

Fixation device 30C according to the second embodiment has almost the same configuration as that of the first embodiment of FIG. 1. In fixation device 30C of the second embodiment, configurations of nip formation member 34C and support body 37C are different from those of nip formation member 34 and support body 37 of the first embodiment.

Figure 19A:
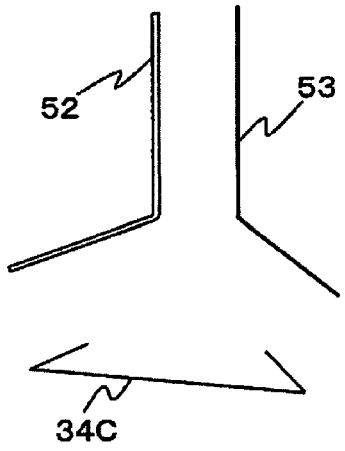
FIGS. 19A and 19B are exploded perspective views of a nip formation member shown in FIG. 18.
Figure 19B:
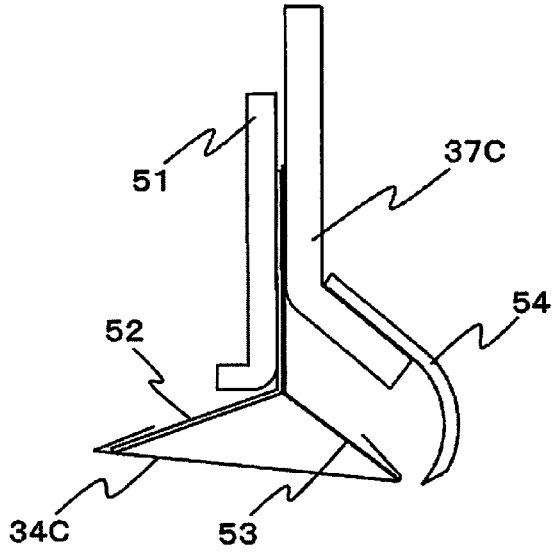

FIGS. 19A and 19B are exploded perspective views of nip formation member 34C shown in FIG. 18.

In FIG. 19B, either end of nip formation member 34C is supported by supporting member 52 and supporting member 53 while being fit in supporting member 52 and supporting member 53, such that either end can rotate freely. Supporting members 52 and 53 are integrated and fixed with stationary member 51 and support body 37C by a screw (s), bond, weld, or the like. Stationary member 51 prevents deformation of supporting member 52 and supporting member 53 when they receive a force in a rotational direction of fixation belt 33.

Belt guide 54 ensures that fixation belt 33 smoothly enters nip 38. Nip formation member 34C is made of iron, stainless, copper, or aluminum, or is made of an alloy including one or more of them. A slide contact surface of nip formation member 34C which is to be in sliding contact with fixation belt 33 may be coated with a low friction coefficient coating such as fluorine type coating, silicon type coating, or the like. To have a spring property, nip formation member 34C has a thickness of approximately from 0.05 mm to 0.5 mm. The length of the thickness of nip formation member 39C may be determined by the required load and deformation amount. Depending on the required pressure distribution, a plurality of nip formation members 34C may be used.

Support 37C and stationary member 51 may be formed of a metal plate made of iron, stainless, aluminum, or the like or made of heat resistant resin such as PPS, LCP, PEEK, or the like. Supporting members 52 and 53 are made of iron, stainless, copper, or aluminum, or are made of an alloy including one or more of them and have a thickness of approximately from 0.05 mm to 0.5 mm to have a spring property.

Belt guide 54 may be made of heat resistant resin such as PPS, LCP, PEEK, or the like, to absorb as little heat as possible from fixation belt 33. Belt guide 54 may be made of metal such as iron, stainless, steel, or aluminum, or an alloy including one or more of them to prevent thermal deformation. A slide contact surface of belt guide 54 which is to be in sliding contact with fixation belt 33 may be coated with a low friction coefficient coating such as fluorine type coating, silicon type coating, or the like.

Figure 20A:
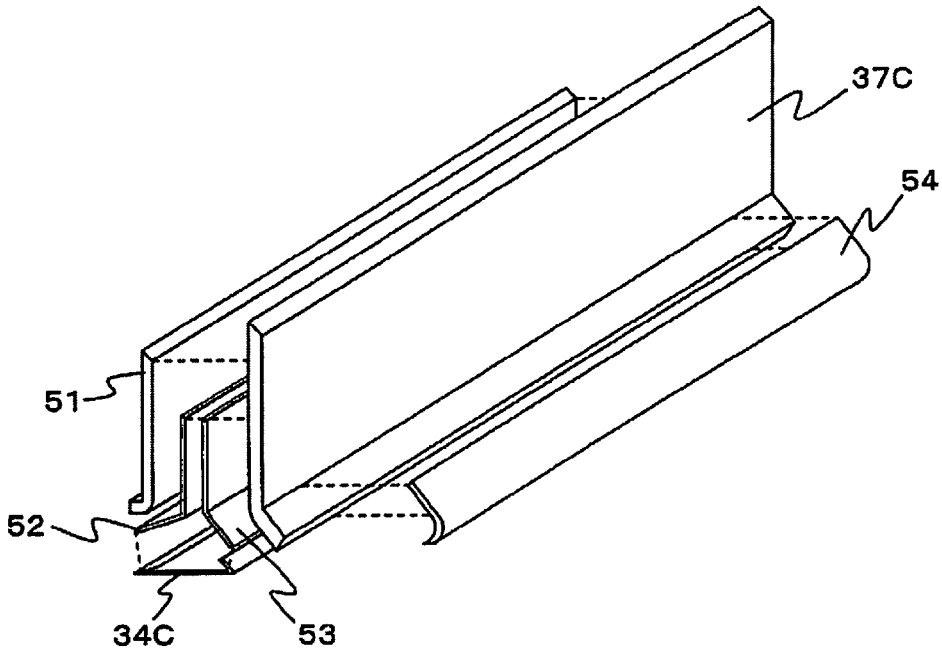
FIGS. 20A and 20B are perspective views illustrating a state where the nip formation member of FIG. 18 is equipped in the fixation device.
Figure 20B:
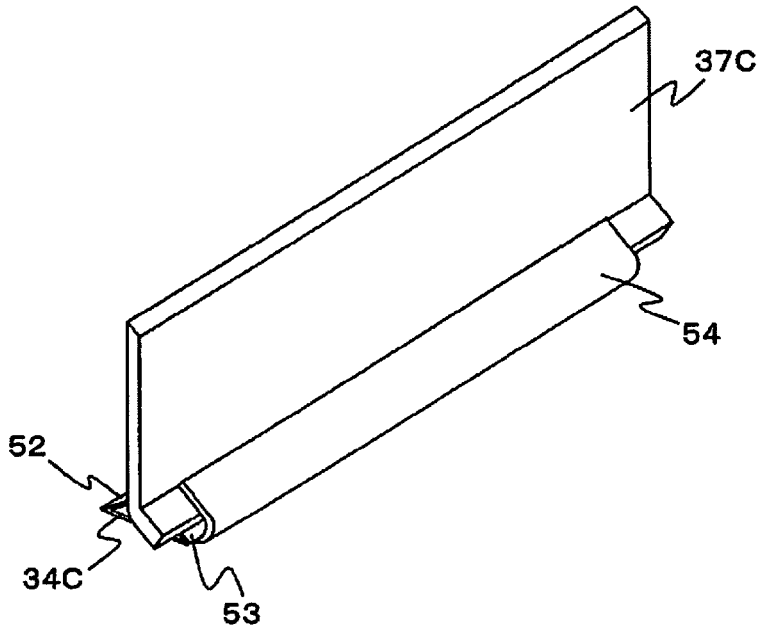

FIGS. 20A and 20B are perspective views illustrating the case where nip formation member 34C of FIG. 18 is included in fixation device 30C.

FIG. 20A is an exploded perspective view illustrating a state before supporting member 52, supporting member 53, and nip formation member 34C are integrated with each other and FIG. 20B is a perspective view illustrating a state where nip formation member 34C is integrated with support body 37C and stationary member 51.

Either end of nip formation member 34C is supported by supporting member 52 and supporting member 53 while being fit into supporting member 52 and supporting member 53. Supporting members 52 and 53 are integrated with and fixed to stationary member 51 and support body 37C by a screw (s), bond, weld, or the like. Belt guide 54 is provided beneath L-like shaped support body 37C.

Figure 21:
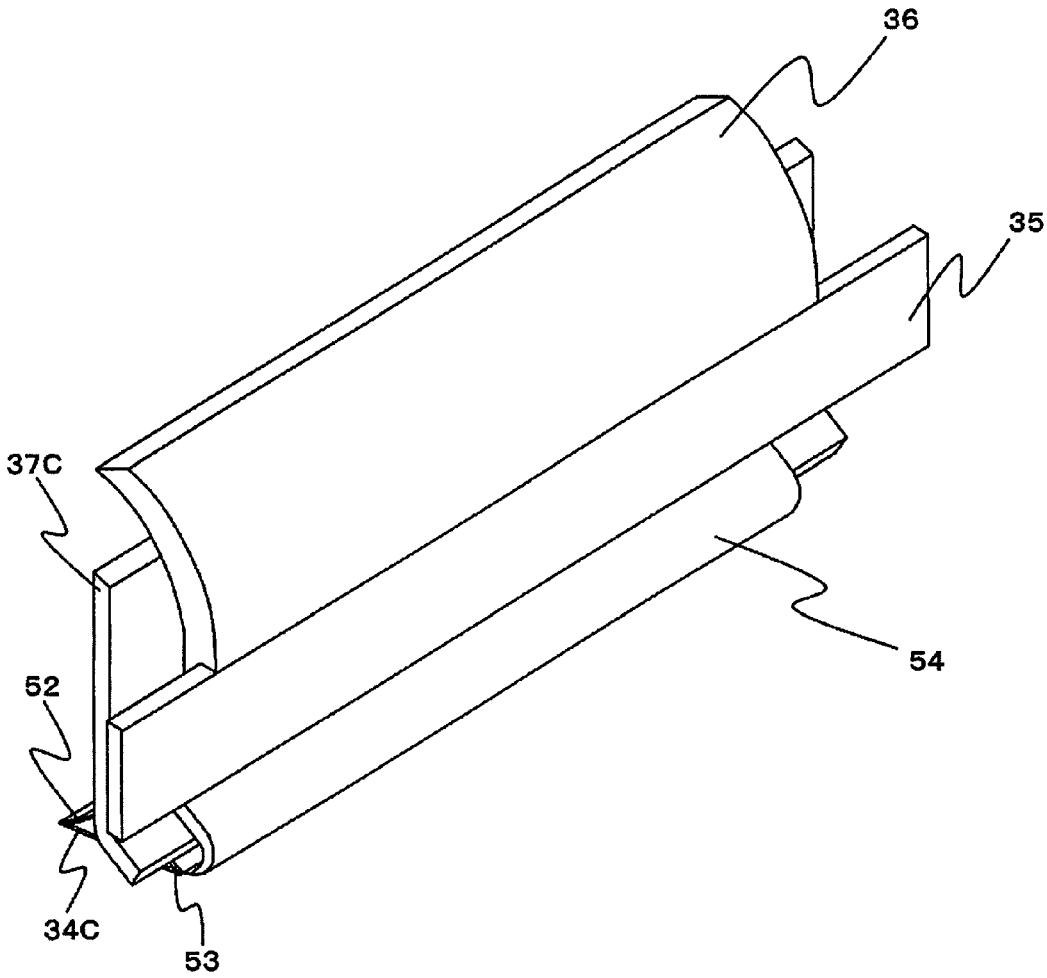
FIG. 21 is a perspective view illustrating a positional relationship among the sheet heating element, the nip formation member, and etc. shown in FIG. 18.

FIG. 21 is a perspective view illustrating a positional relationship among sheet heating element 35, support body 36, support body 37C, supporting member 52, supporting member 53, and nip formation member 34C shown in FIG. 18.

Nip formation member 34C is supported by supporting member 52 and supporting member 53 while being fit into supporting member 52 and supporting member 53. Supporting members 52 and 53 are integrated with and fixed to stationary member 51 and support body 37C by a screw(s), bond, weld, or the like. Stationary member 51 is disposed behind support body 37C and thus cannot be seen in FIG. 21.

Belt guide 54 is attached to a lower portion of support body 37C and is bent along a sliding contact of fixation belt 33 near the lower portion of supporting member 53. Sheet heating element 35 and support body 36 for supporting sheet heating element 35 are provided above belt guide 54 and are combined with each other by being pressed against fixation belt 33.

Figure 22:
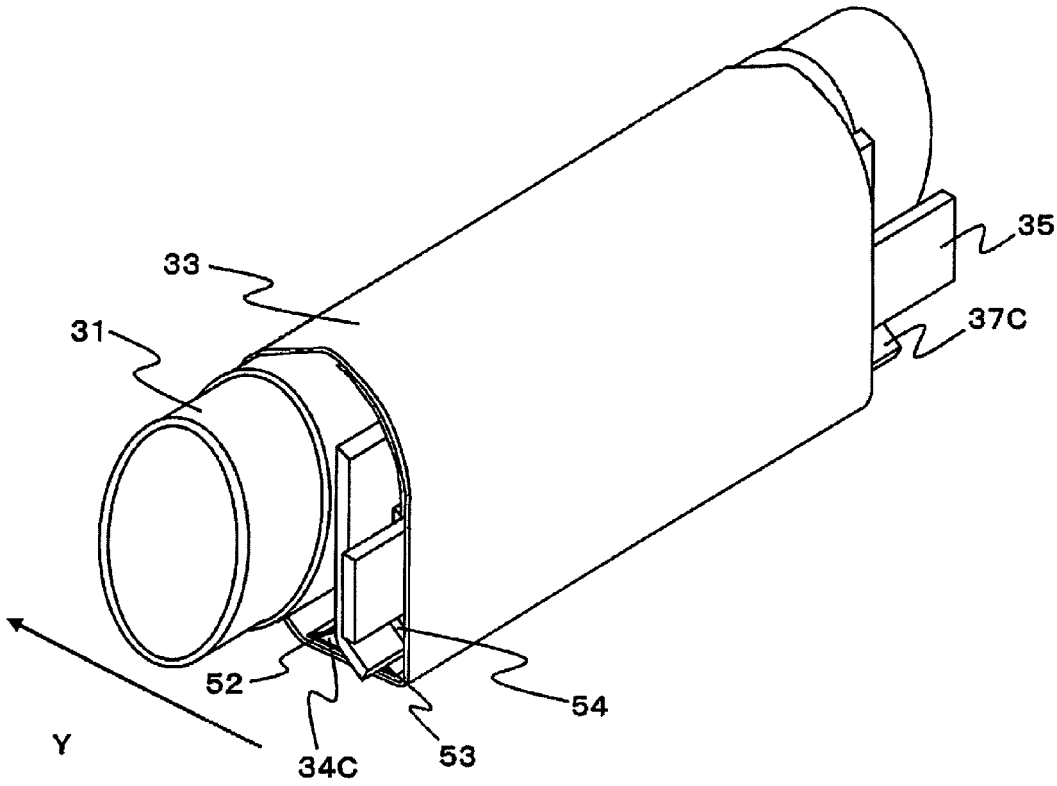
FIG. 22 is a perspective view illustrating a state where components are set in a fixation belt shown in FIG. 18.

FIG. 22 is a perspective view illustrating a state where the components are accommodated in fixation belt 33 shown in FIG. 18.

FIG. 22 shows fixation roller 31, sheet heating element 35, nip formation member 34C, supporting members 52 and 53 for nip formation member 34C, belt guide 54, and support body 37C for belt guide 54, inside fixation belt 33. Note that support body 36 for sheet heating element 35 is provided inside fixation belt 33 but hidden by fixation belt 33 and thus cannot be seen in FIG. 22.

(Operation of Second Embodiment)

In FIG. 18, fixation belt 33 is driven by pressure roller 32 to rotate in the arrow direction while being in sliding contact with support body 36, sheet heating element 35, and nip formation member 34C, as the contact surface of fixation belt 33, which is in contact with sheet heating element 35, is heated by applying electric power to sheet heating element 35.

Temperature detector 39 detects the surface temperature of fixation belt 33 and controller 16 controls the electric power applied to sheet heating element 35 based on the detected surface temperature so as to maintain the surface temperature of fixation belt 33 to an appropriate level. Pressure roller 32 is pressed against fixation roller 31 and nip formation member 34C with fixation belt 33 sandwiched therebetween, thereby forming nip 38C. Sheet P having toner 13 transferred thereon is conveyed through nip 38C between fixation belt 33 and pressure roller 32 and is heated and pressed by fixation belt 33 and pressure roller 32, whereby toner 13 is fixed on sheet P.

(Effects of Second Embodiment)

The second embodiment achieves the following effects, in addition to the effects of fixation device 30 and image formation apparatus 10 of the first embodiment.

Figure 23:
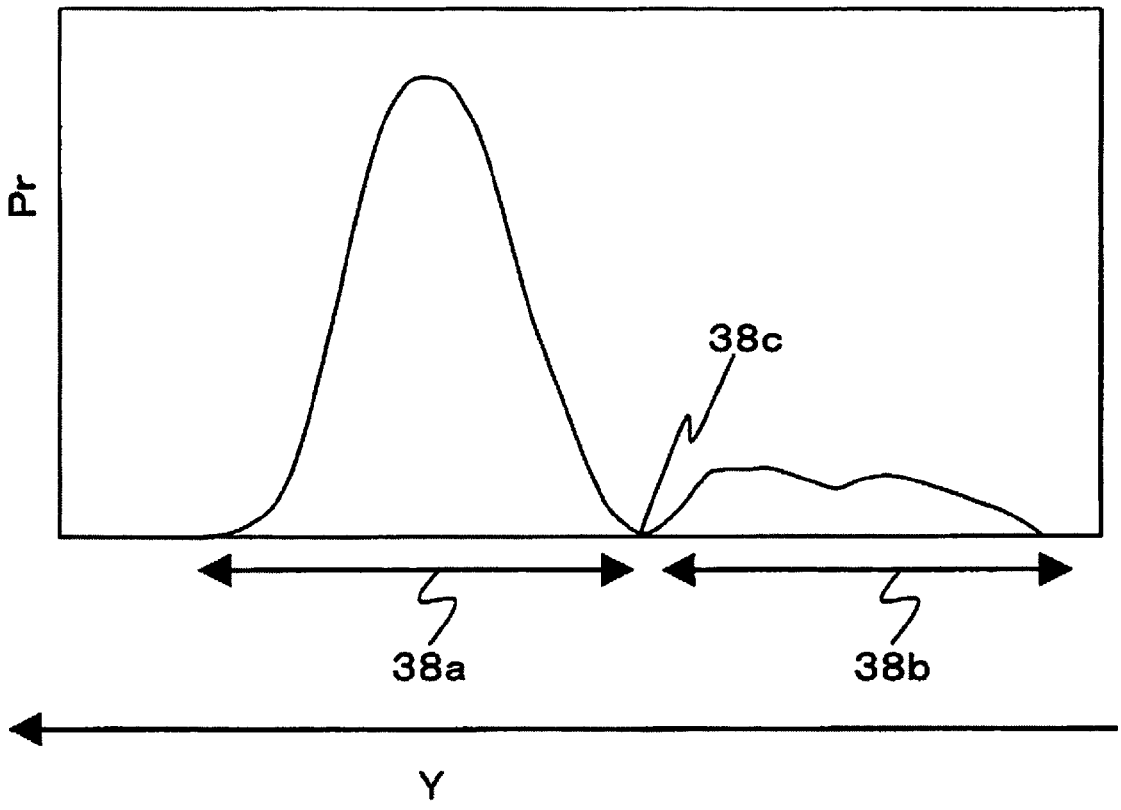
FIG. 23 is a graph showing the pressure distribution in the nip of the fixation device of FIG. 18.

FIG. 23 is a graph showing the pressure distribution in nip 38 of fixation device 30C of FIG. 18.

In the second embodiment, the distance between first nip section 38*a* and second nip section 38*b* is smaller compared to the first embodiment. That is, as shown in FIGS. 12 and 23, pressure drop section 38*c* shown in the pressure distribution of FIG. 23 is shorter than pressure drop section 38*c* shown in the pressure distribution of FIG. 12.

Since pressure drop section 38*c* is shorter in the second embodiment, the possibility that toner 13 on sheet P is influenced by any disturbance is decreased, even through toner 13 on sheet P is not sufficiently fixed to sheet P at second nip section 38*b*. Therefore, the second embodiment achieves printing quality stability.

(Modifications of Second Embodiment)

Figure 24:
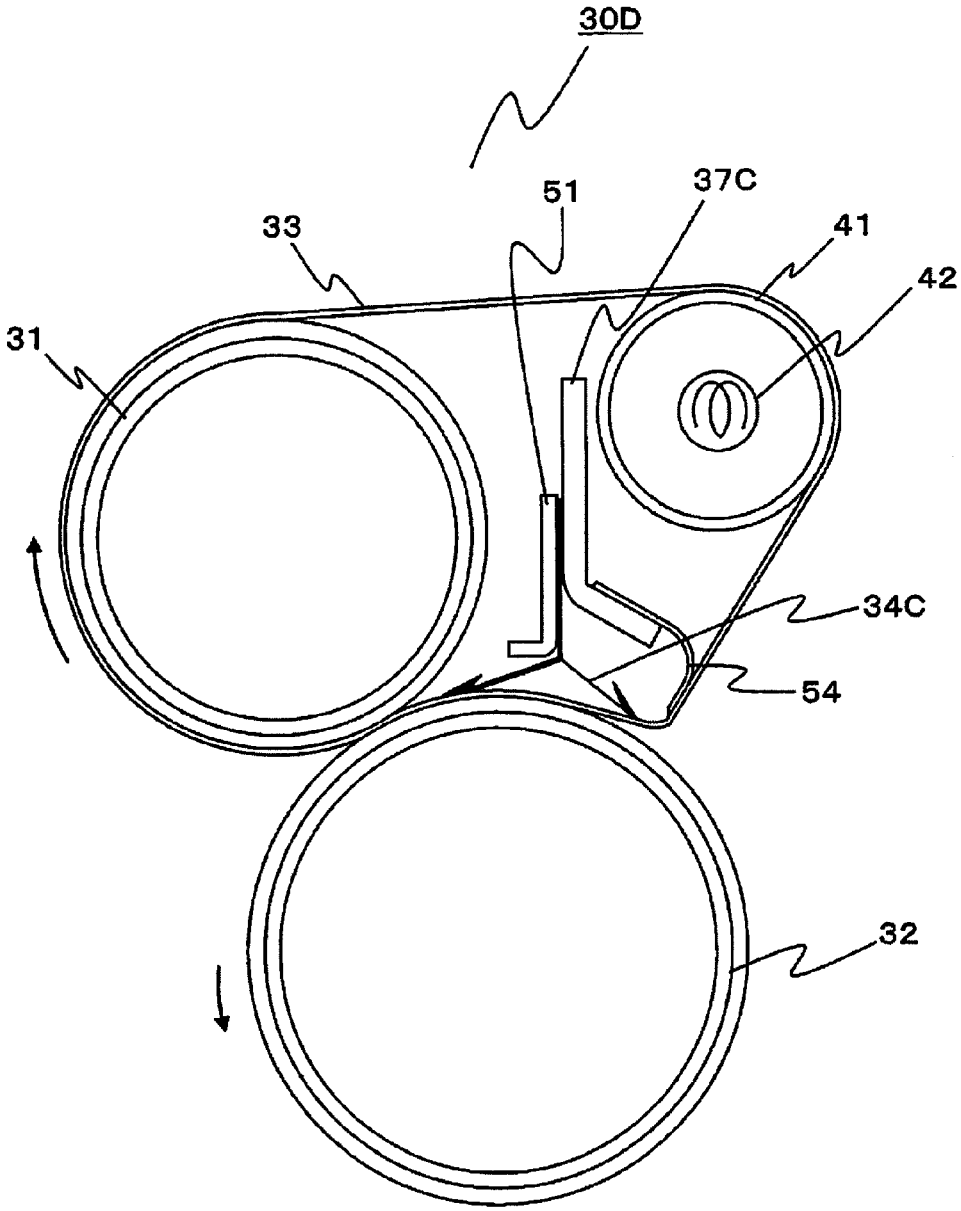
FIG. 24 is a configuration diagram schematically illustrating a first modification of the fixation device of FIG. 18.

FIG. 24 is a configuration diagram schematically illustrating a first modification of fixation device 30C of FIG. 18. In FIG. 24, the same configurations as in FIG. 18 illustrating the second embodiment are designated by the same reference numerals.

Fixation device 30D shown in FIG. 24 has almost the same configuration as that of fixation device 30C shown in FIG. 18 but includes heat roller 41 having heat source 42 therein instead of sheet heating element 35 as a heat source. Heat roller 41 is formed of a hollow pipe made of iron, stainless, aluminum, copper, or the like and heat source 42 is a halogen lamp, for example.

Figure 25:
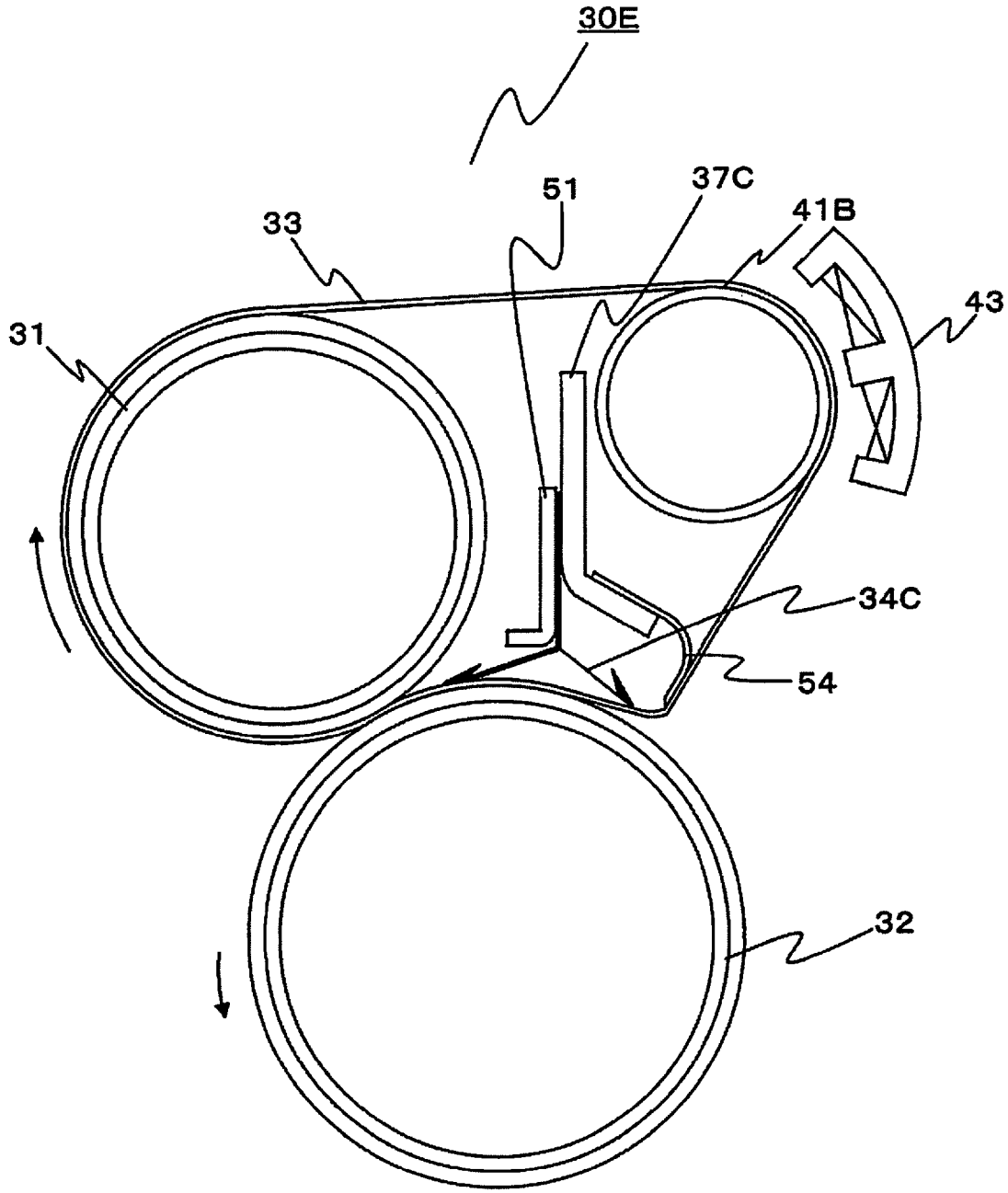
FIG. 25 is a configuration diagram schematically illustrating a second modification of the fixation device of FIG. 18.

FIG. 25 is a configuration diagram schematically illustrating a second modification of fixation device 30C of FIG. 18. In FIG. 25, the same configurations as in FIG. 17 illustrating the first embodiment are designated by the same reference numerals.

Fixation device 30E shown in FIG. 25 has almost the same configuration as that of fixation device 30C shown in FIG. 18 but includes roller 41B and magnetic field generator 43 provided at a position facing roller 41B with fixation belt 33 there between. Magnetic field generator 43 includes an unillustrated magnetizing coil to heat roller 41B and fixation belt 33 by electromagnetic induction.

In this configuration, base 33*a* of fixation belt 33 is made of polyimide or the like kneaded with conductive filler such as nickel, stainless, silver, aluminum, or the like.

As described above, a fixation device according to an aspect of the invention includes: a conveyance member configured to convey a medium; a heater configured to heat the conveyance member; a pressure member being in contact with the conveyance member; a first sandwiching member disposed facing the pressure member with the conveyance member between the first sandwiching member and the pressure member and being in contact with the conveyance member; and a second sandwiching member disposed facing the pressure member with the conveyance member between the second sandwiching member and the pressure member and being in contact with the conveyance member.

Accordingly, this configuration provides a nip including two nip sections: one is formed between the first sandwiching member and the pressure member; the other is formed between the second sandwiching member and the pressure member. Thus, the fixation device provides a longer nip than the conventional art in which a single nip is formed. Therefore, more heat is transferred to the medium passing through the nip than the conventional art. Consequently, the fixation device lowers the temperature of the conveyance member (the fixation temperature) or permits increase of the fixation speed.

Further, an image formation apparatus including the fixation device according to the aspect achieves an electric power saving by lowering the temperature of the conveyance member (the fixation temperature) or permits increasing the printing speed without lowering the temperature of the conveyance member (the fixation temperature).

(Modifications of First and Second Embodiment)

The invention is not limited to the embodiments and the modifications described above and various applications and modifications can be made. The following are examples of the applications and modifications.

Although image forming apparatus 10 is described as a page printer in the first and second embodiments, the image forming apparatus is not limited to this but may be a facsimile machine, a copy machine, a MFP (Multifunction Printer/Product/Peripheral), or the like.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A fixation device comprising:

a conveyance member configured to convey;

a heater configured to heat the conveyance member;

a pressure member being in contact with the conveyance member;

a first sandwiching member disposed facing the pressure member with the conveyance member between the first sandwiching member and the pressure member and being in contact with the conveyance member; and a second sandwiching member disposed facing the pressure member with the conveyance member between the second sandwiching member and the pressure member and being in contact with the conveyance member, the second sandwiching member includes a plate spring and an L-shaped support body including a first support section and a second support section orthogonal to the first support section, the plate spring includes a fixed portion fixed to the first and second support sections of the L-shaped support body and a free end portion extending toward a downstream direction with respect to a rotational direction of the pressure member, wherein the free end portion is curved such that an end region of the free end portion that is furthest away from the L-shaped support body does not make contact with the pressure member.

2. The fixation device according to claim 1, wherein the conveyance member has an inner circumferential surface and an outer circumferential surface and is configured to convey the medium on the outer circumferential surface, the pressure member being in contact with the outer circumferential surface of the conveyance member, the first sandwiching member is in contact with the inner circumferential surface of the conveyance member, the plate spring is in contact with the inner circumferential surface of the conveyance member, and the heater is in contact with the inner circumferential surface of the conveyance member.

3. The fixation device according to claim 1, wherein the heater includes:

a sheet heating element being in contact with the conveyance member and is configured to heat the conveyance member; and a support body supporting the sheet heating element such that the sheet heating element and the support body are in contact with the conveyance member.

4. The fixation device according to claim 1, wherein the heater is a heat roller being in contact with the conveyance member and configured to heat the conveyance member.

5. The fixation device according to claim 1, wherein the conveyance member has an inner circumferential surface and an outer circumferential surface and is configured to convey the medium on the outer circumferential surface, the pressure member being in contact with the outer circumferential surface of the conveyance member, the first sandwiching member is in contact with the inner circumferential surface of the conveyance member, the plate spring is in contact with the inner circumferential surface of the conveyance member, and the heater includes:

a roller disposed in contact with the inner circumferential surface of the conveyance member; and a magnetic field generator disposed facing the roller with the conveyance member between the roller and the magnetic field generator and configured to heat the roller by electromagnetic induction.

6. The fixation device according to claim 1, wherein the plate spring is made of one of metal, rubber, and resin.

7. The fixation device according to claim 1, further comprising:

a first nip section between the first sandwiching member and the conveyance member being in press contact with each other at a first pressure; and a second nip section between the plate spring and the conveyance member being in press contact with each other at a second pressure.

8. The fixation device according to claim 7, wherein the first nip section is provided downstream of the second nip section in the medium conveyance direction, and the first pressure is greater than the second pressure.

9. The fixation device according to claim 1, wherein the conveyance member is a fixation belt being an endless belt.

10. The fixation device according to claim 1, wherein the conveyance member has an inner circumferential surface and an outer circumferential surface and is configured to convey the medium on the outer circumferential surface, the pressure member being in contact with the outer circumferential surface of the conveyance member, the first sandwiching member is in contact with the inner circumferential surface of the conveyance member, the plate spring is in contact with the inner circumferential surface of the conveyance member, and the first sandwiching member is a fixation roller in contact with the inner circumferential surface of the conveyance member to rotate with the movement of the conveyance member.

11. The fixation device according to claim 1, wherein the conveyance member has an inner circumferential surface and an outer circumferential surface and is configured to convey the medium on the outer circumferential surface, the pressure member being in contact with the outer circumferential surface of the conveyance member, the first sandwiching member is in contact with the inner circumferential surface of the conveyance member, and the plate spring is in sliding contact with the inner circumferential surface of the conveyance member upon movement of the conveyance member.

12. The fixation device according to claim 1, wherein the conveyance member has an inner circumferential surface and an outer circumferential surface and is configured to convey the medium on the outer circumferential surface, the pressure member being in contact with the outer circumferential surface of the conveyance member, the first sandwiching member is in contact with the inner circumferential surface of the conveyance member, the plate spring is in contact with the inner circumferential surface of the conveyance member, and the pressure member is a pressure roller in contact with the outer circumferential surface of the conveyance member to rotate with the movement of the conveyance member.

13. The fixation device according to claim 1, wherein the conveyance member has an inner circumferential surface and an outer circumferential surface and is configured to convey the medium on the outer circumferential surface, the pressure member being in contact with the outer circumferential surface of the conveyance member, the first sandwiching member is in contact with the inner circumferential surface of the conveyance member, the plate spring is in contact with the inner circumferential surface of the conveyance member, and the first sandwiching member is a fixation roller in contact with the inner circumferential surface of the conveyance member to rotate with the movement of the conveyance member, and the plate spring is in sliding contact with the inner circumferential surface of the conveyance member upon movement of the conveyance member, wherein the plate spring is provided upstream of the fixation roller in the medium conveyance direction.

14. The fixation device according to claim 13, wherein the pressure member is a pressure roller in contact with the outer circumferential surface of the conveyance member to rotate with the movement of the conveyance member, the fixation device further comprising:

a first nip section provided between the fixation roller and the pressure roller in press contact with the fixation roller at a first pressure; and a second nip section provided between the plate spring and the pressure roller in press contact with the plate spring at a second pressure less than the first pressure.

15. The fixation device according to claim 1, wherein the conveyance member has an inner circumferential surface and an outer circumferential surface and is configured to convey the medium on the outer circumferential surface, the pressure member being in contact with the outer circumferential surface of the conveyance member, the first sandwiching member is a fixation roller in contact with the inner circumferential surface of the conveyance member, the plate spring is in contact with the inner circumferential surface of the conveyance member, and the pressure member is a pressure roller in contact with the outer circumferential surface of the conveyance member to rotate with the movement of the conveyance member, the fixation device further comprising:

a first nip section between the fixation roller and the pressure roller pressed against each other with the conveyance member therebetween at a first pressure; and a second nip section between the plate spring and the pressure roller pressed against each other with the conveyance member therebetween at a second pressure less than the first pressure.

16. An image formation apparatus comprising:

the fixation device according to claim 1; and an image formation section configured to form a developer image with a developer, to transfer the developer image to the medium, and to convey the medium having the developer image thereon to the fixation device.

17. The image formation apparatus according to claim 16, wherein the image formation section comprises:

an image carrier being rotatable for carrying an electrostatic latent image thereon;

a latent image formation device configured to form an electrostatic latent image on the image carrier;

a development unit configured to form a developer image on the image carrier by supplying the developer to the electrostatic latent image; and an image transfer device configured to transfer the developer image from the image carrier to the medium and to convey the medium having the developer image thereon to the fixation device.

18. A fixation device comprising:

a conveyance member configured to convey;

a heater configured to heat the conveyance member;

a pressure member being in contact with the conveyance member;

a first sandwiching member disposed facing the pressure member with the conveyance member between the first sandwiching member and the pressure member and being in contact with the conveyance member; and a second sandwiching member disposed facing the pressure member with the conveyance member between the second sandwiching member and the pressure member and being in contact with the conveyance member, the second sandwiching member includes a plate spring and a support body, wherein the plate spring includes a first support member, a second support member, and a nip formation member.

the first support member includes a fixed portion fixed to the support body and a free end portion extending toward a downstream direction with respect to the rotational direction of the pressure member, the second support member includes a fixed portion fixed to the support body and a free end portion extending toward an upstream direction with respect to the rotational direction of the pressure member, the nip formation member includes a first end portion fixed to the free end portion of the first support member and a second end portion fixed to the free end portion of the second support.

19. The fixation device according to claim 18, wherein the plate spring is made of one of metal, rubber, and resin.

20. The fixation device according to claim 18, further comprising:

a first nip section between the first sandwiching member and the conveyance member being in press contact with each other at a first pressure; and a second nip section between the plate spring and the conveyance member being in press contact with each other at a second pressure.

21. The fixation device according to claim 20, wherein the first nip section is provided downstream of the second nip section in the medium conveyance direction, and the first pressure is greater than the second pressure.

22. An image formation apparatus comprising:

the fixation device according to claim 18; and an image formation section configured to form a developer image with a developer, to transfer the developer image to the medium, and to convey the medium having the developer image thereon to the fixation device.

* * * * *